US010977993B2

(12) United States Patent
Jang et al.

(10) Patent No.: US 10,977,993 B2
(45) Date of Patent: Apr. 13, 2021

(54) ORGANIC LIGHT EMITTING DIODE DISPLAY DEVICE

(71) Applicant: LG ELECTRONICS INC., Seoul (KR)

(72) Inventors: Joonduk Jang, Seoul (KR); Chan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/672,127

(22) Filed: Nov. 1, 2019

(65) Prior Publication Data

US 2020/0184889 A1 Jun. 11, 2020

(30) Foreign Application Priority Data

Dec. 7, 2018 (KR) ..... 10-2018-0157247
Mar. 29, 2019 (KR) ..... 10-2019-0037279

(51) Int. Cl.
*G09G 3/3233* (2016.01)

(52) U.S. Cl.
CPC ..... *G09G 3/3233* (2013.01); *G09G 2320/041* (2013.01)

(58) Field of Classification Search
CPC .... G09G 3/3233; G09G 3/3241; G09G 3/325; G09G 3/3283; G09G 3/3291
See application file for complete search history.

(56) References Cited

U.S. PATENT DOCUMENTS

2004/0201582 A1* 10/2004 Mizukoshi ..... G09G 3/3291 345/211
2011/0205202 A1 8/2011 Son et al.
2012/0044270 A1* 2/2012 Arkhipov ..... G09G 3/32 345/690
2014/0104258 A1 4/2014 Oh et al.
2014/0104259 A1 4/2014 Oh et al.
2014/0198091 A1 7/2014 Shin et al.
2017/0330502 A1 11/2017 Jang
2019/0051240 A1* 2/2019 Nakatani ..... G09G 3/3233

FOREIGN PATENT DOCUMENTS

KR 100680913 2/2007

OTHER PUBLICATIONS

European patent application No. 19204943.5, European search report dated Apr. 14, 2020, 4 pages.

* cited by examiner

*Primary Examiner* — Kevin M Nguyen
(74) *Attorney, Agent, or Firm* — Lee, Hong, Degerman, Kang & Waimey

(57) ABSTRACT

An organic light emitting diode display device includes a panel in which a plurality of pixels are disposed, a power supplier configured to supply a current to the panel, and a controller configured to acquire information about the current supplied to the panel and perform an automatic current limit so that the current supplied to the panel is controlled to a preset current limit value or less. The controller is configured to adjust the current limit value based on the information about the current supplied to the panel.

18 Claims, 16 Drawing Sheets

ORGANIC LIGHT EMITTING DIODE DISPLAY DEVICE

CROSS-REFERENCE TO RELATED APPLICATIONS

Pursuant to 35 U.S.C. § 119(a), this application claims the benefit of earlier filing date and right of priority to Korean Patent Application Nos. 10-2018-0157247, filed on Dec. 7, 2018, and 10-2019-0037279, filed on Mar. 29, 2019, the contents of which are all hereby incorporated by reference herein in their entirety.

BACKGROUND

The present invention relates to an organic light emitting diode display device, and more particularly, to reduction in temperature of an organic light emitting diode display device.

In recent years, the types of display devices have been diversified. Among them, an organic light emitting diode (OLED) display device is widely used.

Since the OLED display device is a self-luminous device, the OLED display device has lower power consumption and can be made thinner than a liquid crystal display (LCD) requiring a backlight. In addition, the OLED display device has a wide viewing angle and a fast response time.

In a general OLED display device, red, green, and blue sub-pixels constitute one unit pixel and an image having various colors may be displayed through the three sub-pixels.

Specifically, the OLED display device may display an image by supplying a current to at least one of the red, green, and blue sub-pixels. For example, the OLED display device may implement a red color in a corresponding pixel by supplying a current to only a red sub-pixel and not supplying a current to green and blue sub-pixels. In addition, the OLED display device may implement secondary colors such as yellow, cyan, and magenta by supplying a current to two sub-pixels among red, green, and blue sub-pixels.

The OLED display device may require a high current when an image including a plurality of secondary colors, such as animation, is displayed or an image mode is set to a vivid mode which increases color saturation and/or contrast. In this case, the temperature of the panel may be excessively increased.

As the prior art for preventing overheating of the OLED display device, Korean Patent Registration No. 10-0680913 (published Feb. 8, 2007) discloses a configuration that measures a heat generated in the OLED display device by a temperature sensor and determines a power supply voltage applied to the OLED display device according to temperature data input by the temperature sensor.

SUMMARY

The present invention is directed to minimize overheating of an OLED display device by controlling a current supplied to a panel based on information about a current supplied to the panel, without a separate measurement device such as a temperature sensor.

The invention is specified by the independent claims. Preferred embodiments are defined in the dependent claims.

An organic light emitting diode display device according to an embodiment of the present invention comprising a panel in which a plurality of pixels are disposed, a power supplier configured to supply a current to the panel, and a controller configured to acquire information about the current supplied to the panel and perform an automatic current limit so that the current supplied to the panel is controlled to a preset current limit value or less, wherein the controller is configured to adjust the current limit value based on the information about the current supplied to the panel.

An operating method of an organic light emitting diode display device including a panel in which a plurality of pixels are disposed according to an embodiment of the present invention comprising supplying a current to the panel, performing an automatic current limit so that the current supplied to the panel is controlled to a preset current limit value or less, sensing the current supplied to the panel, and adjusting the current limit value based on the sensed current.

The present invention also relates to a display device comprising a panel in which a plurality of pixels are disposed; a power supplier configured to supply a current to the panel; and a controller configured to receive information on the current supplied to the panel; set a current limit value so that the current supplied to the panel is at or below the preset current limit value; and adjust the current limit value based on the information about the current supplied to the panel.

Preferably, the controller is configured to calculate a cumulative current based on the information on the current supplied to the panel.

Preferably, the controller is configured to set the current limit value to a first limit value or a second limit value based on the cumulative current, wherein the second limit value is less than the first limit value.

Preferably, the controller is configured to calculate the cumulative current by summing the differences between a present current supplied to the panel and a reference value for each set period of time.

Preferably, the controller is configured to calculate the cumulative current at a certain instance of time T by summing the difference between a present current supplied to the panel and a reference value at the certain time T and the cumulative current at the immediately previous instance of time T−1.

Preferably the reference value is less than the second limit value.

Preferably, the controller is configured to set the current limit value to the second limit value when the cumulative current is at or above a decrease condition value.

Preferably, the decrease condition value serves as a reference value for decreasing the current limit value.

Preferably, the controller is configured to set the current limit value to the first limit value when the cumulative value is less than an increase condition value, wherein the increase condition value serves as a reference for increasing the current limit value.

Preferably, the controller is configured to maintain the current limit value at the first limit value when the current limit value is set to the first limit value and the cumulative current is less than the decrease condition value.

Preferably, the controller is configured to maintain the current limit value at the second limit value when the current limit value is set to the second limit value and the cumulative current is at the increase condition value or more.

Preferably, the controller is configured to correct the cumulative current to a preset minimum value when the cumulative current is less than the preset minimum value.

Preferably, the controller is configured to correct the cumulative current to a preset maximum value when the cumulative current is at the preset maximum value or more.

Preferably, the controller is configured to adjust the current limit value when a temperature reduction function is set.

Preferably, the controller is configured to fix the current limit value when the temperature reduction function is released.

Preferably, the controller is configured to set the current limit value to the first limit value or the second limit value less than the first limit value when the temperature reduction function is set.

Preferably, the controller is configured to fix the current limit value to one of the first limit value and the second limit value when the temperature reduction function is released.

Preferably, the controller is configured to reset the cumulative current to zero and calculate the cumulative current when a setting command of the temperature reduction function is received in a state in which the temperature reduction function is released.

Preferably, the controller is configured to set the current limit value to the first limit value or the second limit value based on the cumulative current.

Preferably, the controller is configured to, when the current limit value is adjusted, gradually increase the current limit value according to a setting ratio or gradually decrease the current limit value according to the setting ratio.

Preferably, the controller is configured to compare a present current supplied to the panel with a third limit value and set the current limit value to a first limit value or a second limit value less than the normal limit value.

Preferably, the controller is configured to set the current limit value to the first limit value when the present current is less than the third limit value.

Preferably, the controller is configured to set the current limit value to the second limit value when the present current is the third limit value or more.

The present invention also relates to an operating method of an display device including a panel in which a plurality of pixels are disposed, the operating method comprising supplying a current to the panel; receiving information on the current supplied to the panel; setting a current limit value so that the current supplied to the panel is at or below the preset current limit value; and adjusting the current limit value based on the information about the current supplied to the panel.

DETAILED DESCRIPTION OF THE EMBODIMENTS

Hereinafter, the present invention will be described in detail with reference to the drawings.

The suffixes "module" and "unit" for components used in the description below are assigned or mixed in consideration of easiness in writing the specification and do not have distinctive meanings or roles by themselves.

Figure 1:
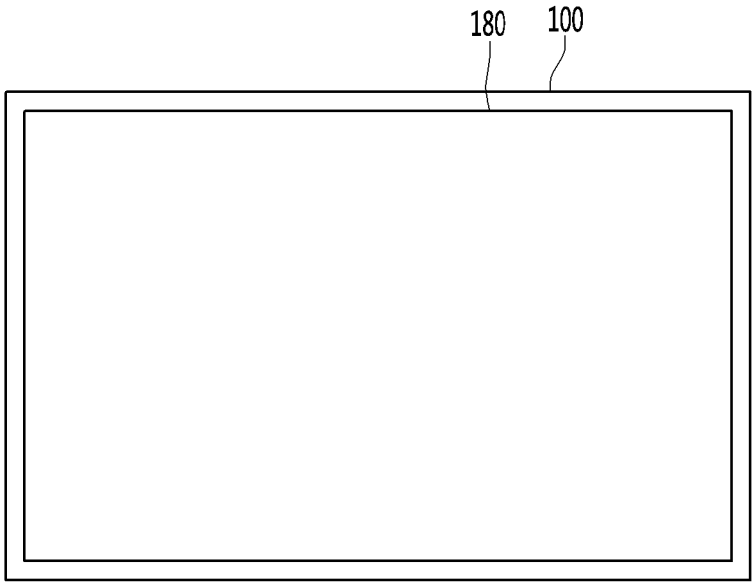
FIG. 1 is a diagram illustrating an image display apparatus according to an embodiment of the present invention.

FIG. 1 is a diagram illustrating an image display apparatus according to an embodiment of the present invention.

With reference to the drawings, an image display apparatus 100 includes a display 180.

On the other hand, the display 180 is realized by one among various panels. For example, the display 180 is one of the following panels: a liquid crystal display panel (LCD panel), an organic light-emitting diode (OLED) panel (OLED panel), and an inorganic light-emitting diode (OLED) panel (ILED panel).

According to the present invention, the display 180 is assumed to include an organic light-emitting diode (OLED) panel (OLED).

On the other hand, examples of the image display apparatus 100 in FIG. 1 include a monitor, a TV, a tablet PC, a mobile terminal, and so on.

Figure 2:
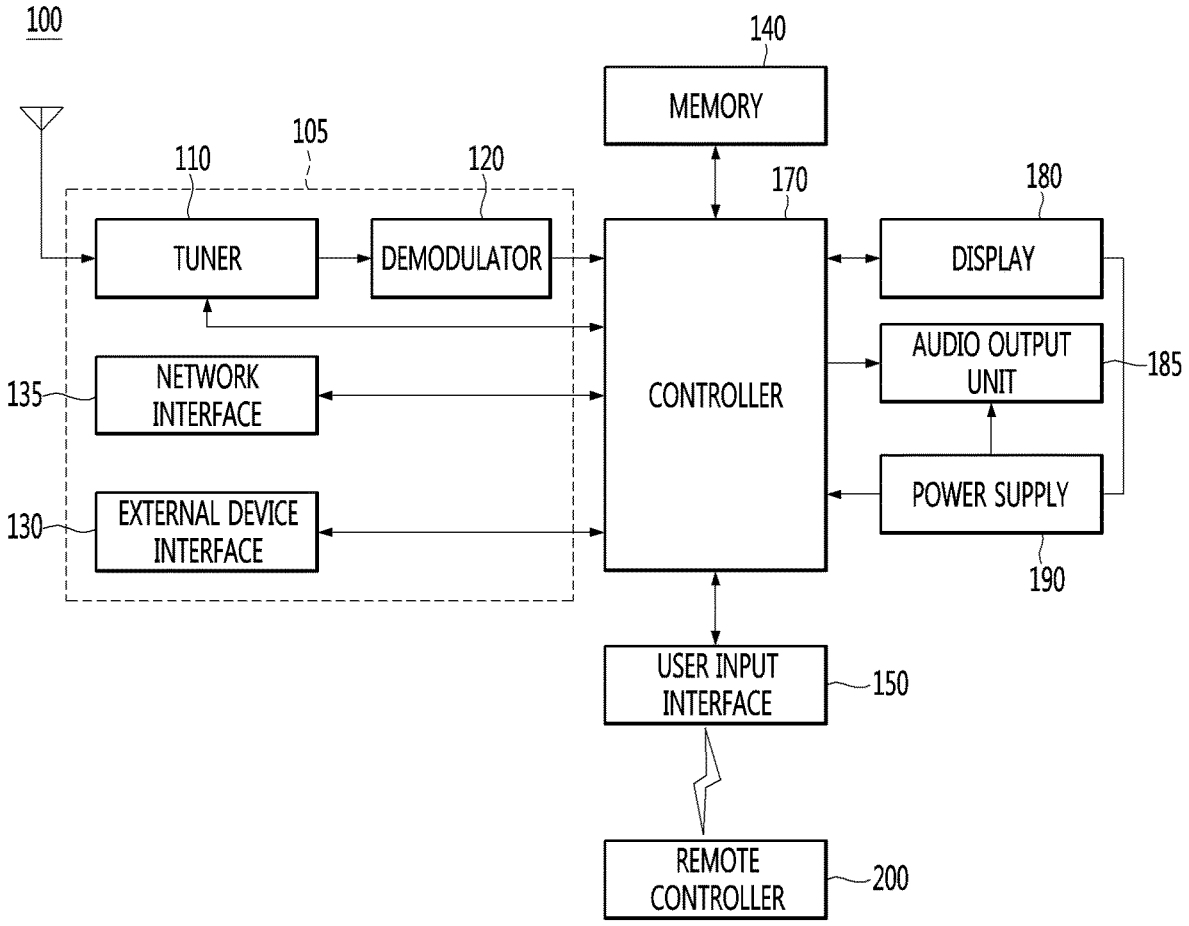
FIG. 2 is an example of a block diagram of the inside of the image display apparatus in FIG. 1.

FIG. 2 is an example of a block diagram of the inside of the image display apparatus in FIG. 1.

With reference to FIG. 2, the image display apparatus 100 according to an embodiment of the present invention includes a broadcast reception unit 105, an external device interface 130, a memory 140, a user input interface 150, a sensor unit (not illustrated), a controller 170, a display 180, an audio output unit 185, and a power supply unit 190.

The broadcast reception unit 105 includes a tuner unit 110, a demodulator 120, a network interface 135, and an external device interface 130.

On the other hand, unlike in the drawings, it is also possible that the broadcast reception unit 105 only includes the tuner unit 110, the demodulator 120, and the external device interface 130. That is, the network interface 135 may not be included.

The tuner unit 110 selects a radio frequency (RF) broadcast signal that corresponds to a channel which is selected by a user, or RF broadcast signals that correspond to all channels that are already stored, among RF broadcast signals that are received through an antenna (not illustrated). In addition, the selected RF broadcast signal is converted into an intermediate frequency signal, a baseband image, or an audio signal.

For example, the selected RF broadcast signal, if is a digital broadcast signal, is converted into a digital IF (DIF) signal, and, if is an analog broadcast signal, is converted into an analog baseband image or an audio signal (CVBS/SIF). That is, the tuner unit 110 processes a digital broadcast signal or an analog broadcast signal. The analog baseband image or the audio signal (CVBS/SIF) output from the tuner unit 110 is input directly into the controller 170.

On the other hand, the tuner unit 110 possibly includes a plurality of tuners in order to receive broadcast signals in a plurality of channels. In addition, it is also possible that a signal tuner that receives the broadcast signals in the plurality of channels at the same time is included.

The demodulator 120 receives a digital IF (DIF) signal that results from the conversion in the tuner unit 110 and performs a demodulation operation on the received digital IF signal.

The demodulator 120 performs demodulation and channel decoding, and then outputs a stream signal (TS). At this time, the stream signal is a signal that results from multiplexing image signals, audio signals, or data signals.

The stream signal output from the demodulator 120 is input into the controller 170. The controller 170 performs demultiplexing, video and audio signal processing, and so on, and then outputs the resulting image to the display 180 and outputs the resulting audio to the audio output unit 185.

The external device interface 130 transmits or receives data to and from an external apparatus (not illustrated) connected, for example, a set-top box. To do this, the external device interface 130 includes an A/V input and output unit (not illustrated).

The external device interface 130 is connected in a wired or wireless manner to an external apparatus, such as a digital versatile disc (DVD), a Blu-ray disc, a game device, a camera, a camcorder, a computer (a notebook computer), or a set-top box, and may perform inputting and outputting operations for reception and transmission of data to and from the external apparatus.

An image and an audio signal of the external apparatus are input into the A/V input and output unit. On the other hand, a wireless communication unit (not illustrated) performs a short-distance wireless communication with a different electronic apparatus.

Through the wireless communication unit (not illustrated), the external device interface 130 transmits and receives data to and from the nearby mobile terminal (not illustrated). Particularly, in a mirroring mode, the external device interface 130 receives device information, information on an application executed, an application image, and so on from the mobile terminal 600.

The network interface 135 provides an interface for connecting the image display apparatus 100 to wired and wireless networks including the Internet. For example, the network interface 135 receives items of content or pieces of data pieces that are provided by a content provider or a network operator through a network or the Internet.

On the other hand, the network interface 135 includes the wireless communication unit (not illustrated).

A program for controlling processing or control of each signal within the controller 170 may be stored in the memory 140. An image signal, an audio signal, or a data signal, which results from signal processing, may be stored in the memory 140.

In addition, an image signal, an audio signal, or a data signal, which is input into the external device interface 130, may be temporarily stored in the memory 140. In addition, information on a predetermined broadcast channel may be stored in the memory 140 through a channel storage function such as a channel map.

An embodiment in which the memory 140 is provided separately from the controller 170 is illustrated in FIG. 2, but the scope of the present invention is not limited to this. The memory 140 is included within the controller 170.

The user input interface 150 transfers a signal input by the user, to the controller 170, or transfers a signal from the controller 170 to the user.

For example, user input signals, such as power-on and -off signals, a channel selection signal, and a screen setting signal, are transmitted and received to and from a remote controller 200, user input signals that are input from local keys (not illustrated), such as a power key, a channel key, a volume key, and a setting key, are transferred to the controller 170, a user input signal input from the sensing unit (not illustrated) that senses a user's gesture is transferred to the controller 170, or a signal from the controller 170 is transmitted to the sensing unit (not illustrated).

The controller 170 demultiplexes a stream input through the tuner unit 110, the demodulator 120, the network interface 135, the external device interface 130, or processes signals that results from demultiplexing, and thus generates and outputs a signal for outputting an image and audio.

An image signal that results from image-processing in the controller 170 is input into the display 180, and an image that corresponds to the image signal is displayed. In addition, the image signal that results from the image-processing in the controller 170 is input into an external output apparatus through the external device interface 130.

An audio signal that results from processing in the controller 170 is output, as audio, to the audio output unit 185. In addition, an audio signal that results from processing in the controller 170 is input into an external output apparatus through the external device interface 130.

Although not illustrated in FIG. 2, the controller 170 includes a demultiplexer, an image processing unit, and so on. The details of this will be described below with reference to FIG. 3.

In addition, the controller 170 controls an overall operation within the image display apparatus 100. For example, the controller 170 controls the tuner unit 110 in such a manner that the tuner unit 110 performs selection of (tuning to) a RF broadcast that corresponds to a channel selected by the user or a channel already stored.

In addition, the controller 170 controls the image display apparatus 100 using a user command input through the user input interface 150, or an internal program.

On the other hand, the controller 170 controls the display 180 in such a manner that an image is displayed. At this time, the image displayed on the display 180 is a still image, or a moving image, and is a 2D image or a 3D image.

On the other hand, the controller 170 is configured to a predetermined object is displayed within the image displayed on the display 180. For example, the object is at least one of the following: a web screen (a newspaper, a magazine, or so on) connected, an electronic program guide (EPG), various menus, a widget, an icon, a still image, a moving image, and text.

On the other hand, the controller 170 recognizes a location of the user, based on an image captured by an imaging unit (not illustrated). For example, a distance (a z-axis coordinate) between the user and the image display apparatus 100 is measured. In addition, a x-axis coordinate and a y-axis coordinate within the display 180, which correspond to the location of the user are calculated.

The display 180 converts an image signal, a data signal, an OSD signal, a control signal that result from the processing in the controller 170, or an image signal, a data signal, a control signal, and so on that are received in the external device interface 130, and generates a drive signal.

On the other hand, the display 180 is configured with a touch screen, and thus is also possibly used as an input device, in addition to an output device.

The audio output unit 185 receives a signal that results from audio processing the controller 170, as an input, and outputs the signal, as audio.

The imaging unit (not illustrated) captures an image of the user. The imaging unit (not illustrated) is realized as one camera, but is not limited to the one camera. It is also possible that the image unit is realized as a plurality of cameras. Information of an image captured by the imaging unit (not illustrated) is input into the controller 170.

Based on the image captured by the imaging unit (not illustrated), or on an individual signal detected by the sensing unit (not illustrated) or a combination of the detected individual signals, the controller 170 detects the user's gesture.

A power supply unit 190 supplies required powers to the entire image display apparatus 100. Particularly, a power is supplied to the controller 170 realized in the form of a system-on-chip (SOC), the display 180 for image display, the audio output unit 185 for audio output, and so on.

Specifically, the power supply unit 190 includes a converter that converts an alternating current power into a direct current power, and a dc/dc converter that converts a level of the direct current power.

The remote controller 200 transmits a user input to the user input interface 150. To do this, the remote controller 200 employs Bluetooth, radio frequency (RF) communication, infrared (IR) communication, ultra-wideband (UWB), a ZigBee specification, and so on. In addition, the remote controller 200 receives an image signal, an audio signal, or a data signal output from the user input interface 150, and displays the received signal on a display unit of the remote controller 200 or outputs the received signal, as audio, to an output unit of the remote controller 200.

On the other hand, the image display apparatus 100 described above is a digital broadcast receiver that possibly receives a fixed-type or mobile-type digital broadcast.

On the other hand, a block diagram of the image display apparatus 100 illustrated in FIG. 2 is a block diagram for an embodiment of the present invention. Each constituent element in the block diagram is subject to integration, addition, or omission according to specifications of the image display apparatus 100 actually realized. That is, two or more constituent elements are to be integrated into one constituent element, or one constituent element is to be divided into two or more constituent elements. In addition, a function performed in each block is for description of an embodiment of the present invention, and specific operation of each constituent element imposes no limitation to the scope of the present invention.

Figure 3:
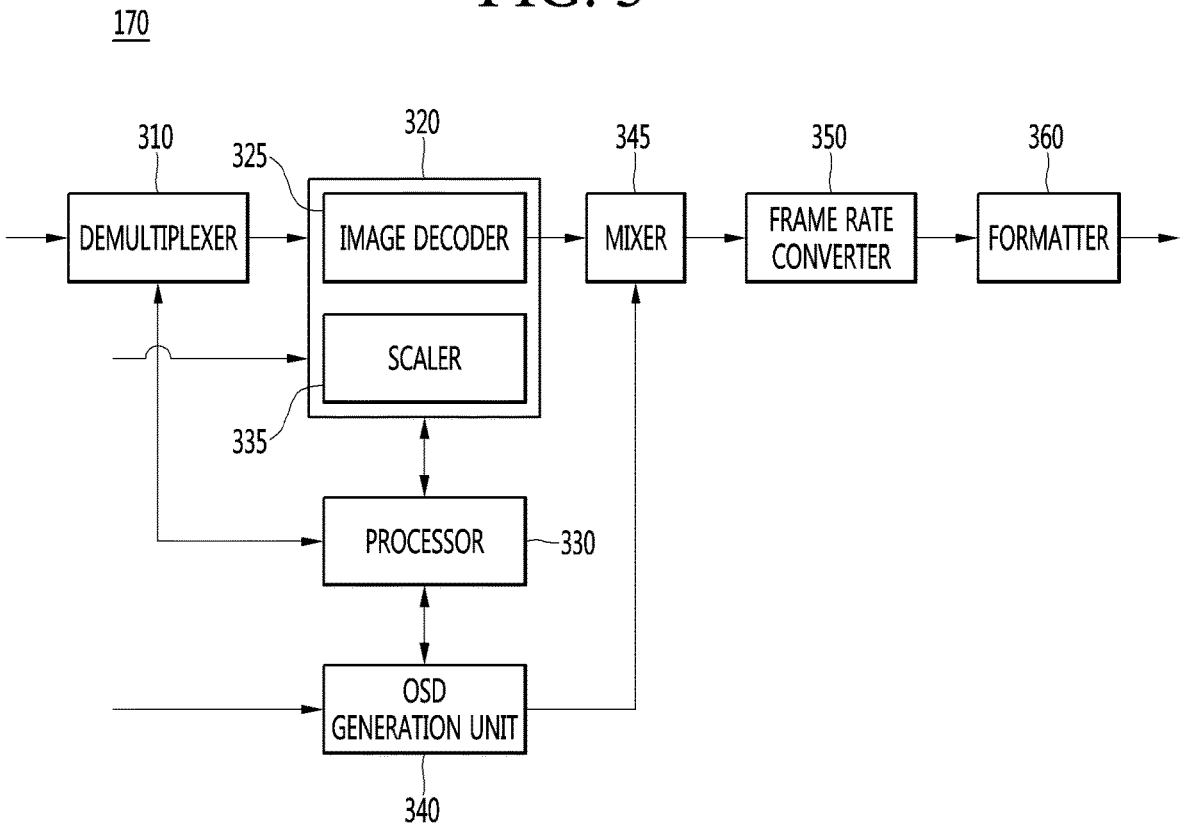
FIG. 3 is an example of a block diagram of the inside of a controller in FIG. 2.

FIG. 3 is an example of a block diagram of the inside of a controller in FIG. 2.

For description with reference to the drawings, the controller 170 according to an embodiment of the present invention includes a demultiplexer 310, an image processing unit 320, a processor 330, an OSD generation unit 340, a mixer 345, a frame rate converter 350, and a formatter 360. In addition, an audio processing unit (not illustrated) and a data processing unit (not illustrated) are further included.

The demultiplexer 310 demultiplexes a stream input. For example, in a case where an MPEG-2 TS is input, the MPEG-2 TS is demultiplexed into an image signal, an audio signal, and a data signal. At this point, a stream signal input into the demultiplexer 310 is a stream signal output from the tuner unit 110, the demodulator 120, or the external device interface 130.

The image processing unit 320 performs image processing of the image signal that results from the demultiplexing. To do this, the image processing unit 320 includes an image decoder 325 or a scaler 335.

The image decoder 325 decodes the image signal that results from the demultiplexing. The scaler 335 performs scaling in such a manner that a resolution of an image signal which results from the decoding is such that the image signal is possibly output to the display 180.

Examples of the image decoder 325 possibly include decoders in compliance with various specifications. For example, the examples of the image decoder 325 include a decoder for MPEG-2, a decoder for H.264, a 3D image decoder for a color image and a depth image, a decoder for a multi-point image, and so on.

The processor 330 controls an overall operation within the image display apparatus 100 or within the controller 170. For example, the processor 330 controls the tuner unit 110 in such a manner that the tuner unit 110 performs the selection of (tuning to) the RF broadcast that corresponds to the channel selected by the user or the channel already stored.

In addition, the processor 330 controls the image display apparatus 100 using the user command input through the user input interface 150, or the internal program.

In addition, the processor 330 performs control of transfer of data to and from the network interface 135 or the external device interface 130.

In addition, the processor 330 controls operation of each of the demultiplexer 310, the image processing unit 320, the OSD generation unit 340, and so on within the controller 170.

The OSD generation unit 340 generates an OSD signal, according to the user input or by itself. For example, based on the user input signal, a signal is generated for displaying various pieces of information in a graphic or text format on a screen of the display 180. The OSD signal generated includes various pieces of data for a user interface screen of the image display apparatus 100, various menu screens, a widget, an icon, and so on. In addition, the OSD generated signal includes a 2D object or a 3D object.

In addition, based on a pointing signal input from the remote controller 200, the OSD generation unit 340 generates a pointer possibly displayed on the display. Particularly, the pointer is generated in a pointing signal processing unit, and an OSD generation unit 340 includes the pointing signal processing unit (not illustrated). Of course, it is also possible that instead of being providing within the OSD generation unit 340, the pointing signal processing unit (not illustrated) is provided separately.

The mixer 345 mixes the OSD signal generated in the OSD generation unit 340, and the image signal that results from the image processing and the decoding in the image processing unit 320. An image signal that results from the mixing is provided to the frame rate converter 350.

The frame rate converter (FRC) 350 converts a frame rate of an image input. On the other hand, it is also possible that the frame rate converter 350 outputs the image, as is, without separately converting the frame rate thereof.

On the other hand, the formatter 360 converts a format of the image signal input, into a format for an image signal to be displayed on the display, and outputs an image that results from the conversion of the format thereof.

The formatter 360 changes the format of the image signal. For example, a format of a 3D image signal is changed to any one of the following various 3D formats: a side-by-side format, a top and down format, a frame sequential format, an interlaced format, and a checker box format.

On the other hand, the audio processing unit (not illustrated) within the controller 170 performs audio processing of an audio signal that results from the demultiplexing. To do this, the audio processing unit (not illustrated) includes various decoders.

In addition, the audio processing unit (not illustrated) within the controller 170 performs processing for base, treble, volume adjustment and so on.

The data processing unit (not illustrated) within the controller 170 performs data processing of a data signal that results from the demultiplexing. For example, in a case where a data signal that results from the demultiplexing is a data signal the results from coding, the data signal is decoded. The data signal that results from the coding is an electronic program guide that includes pieces of broadcast information, such as a starting time and an ending time for a broadcast program that will be telecast in each channel.

On the other hand, a block diagram of the controller 170 illustrated in FIG. 3 is a block diagram for an embodiment of the present invention. Each constituent element in the block diagram is subject to integration, addition, or omission according to specifications of the image display controller 170 actually realized.

Particularly, the frame rate converter 350 and the formatter 360 may be provided separately independently of each other or may be separately provided as one module, without being provided within the controller 170.

Figure 4A:
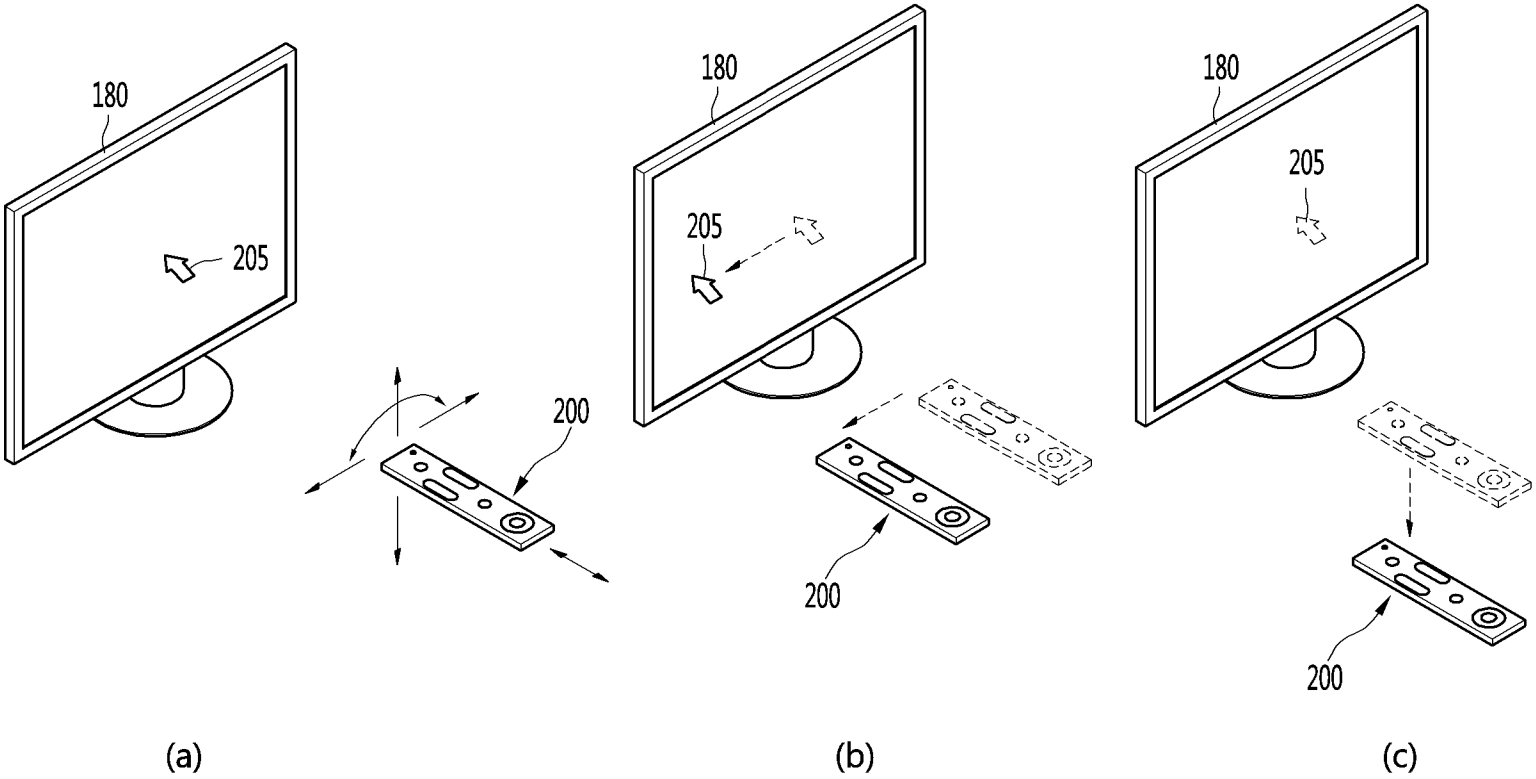
FIG. 4A is a diagram illustrating a method in which the remote controller in FIG. 2 performs control.

FIG. 4A is a diagram illustrating a method in which the remote controller in FIG. 2 performs control.

In FIG. 4A(a), it is illustrated that a pointer 205 which corresponds to the remote controller 200 is displayed on the display 180.

The user moves or rotates the remote controller 200 upward and downward, leftward and rightward (FIG. 4A(b)), and forward and backward (FIG. 4A(c)). The pointer 205 displayed on the display 180 of the image display apparatus corresponds to movement of the remote controller 200. As in the drawings, movement of the pointer 205, which depends on the movement of the remote controller 200 in a 3D space, is displayed and thus, the remote controller 200 is named a spatial remote controller or a 3D pointing device.

FIG. 4A(b) illustrates that, when the user moves the remote controller 200 leftward, the pointer 205 displayed on the display 180 of the image display apparatus correspondingly moves leftward.

Information on the movement of the remote controller 200, which is detected through a sensor of the remote controller 200, is transferred to the image display apparatus. The image display apparatus calculates the information on the movement of the remote controller 200 from coordinates of the pointer 205. The image display apparatus displays the pointer 205 in such a manner that the pointer 25 corresponds to the calculated coordinates.

FIG. 4A(c) illustrates a case where the user moves the remote controller 200 away from the display 180 in a state where a specific button within the remote controller 200 is held down. Accordingly, a selection area within the display 180, which corresponds to the pointer 205, is zoomed in so that the selection area is displayed in an enlarged manner. Conversely, in a case where the user causes the remote controller 200 to approach the display 180, the selection area within the display 180, which corresponds to the pointer 205, is zoomed out so that the selection is displayed in a reduced manner. On the other hand, in a case where the remote controller 200 moves away from the display 180, the selection area may be zoomed out, and in a case where the remote controller 200 approaches the display 180, the selection area may be zoomed in.

On the other hand, an upward or downward movement, or a leftward or rightward movement is not recognized in a state where a specific button within the remote controller 200 is held down. That is, in a case where the remote controller 200 moves away from or approaches the display 180, only a forward or backward movement is set to be recognized without the upward or downward movement, or the leftward or rightward movement being recognized. Only the pointer 205 moves as the remote controller 200 moves upward, downward, leftward, or rightward, in a state where a specific button within the remote controller 200 is not held down.

On the other hand, a moving speed or a moving direction of the pointer 205 corresponds to a moving speed or a moving direction of the remote controller 200, respectively.

Figure 4B:
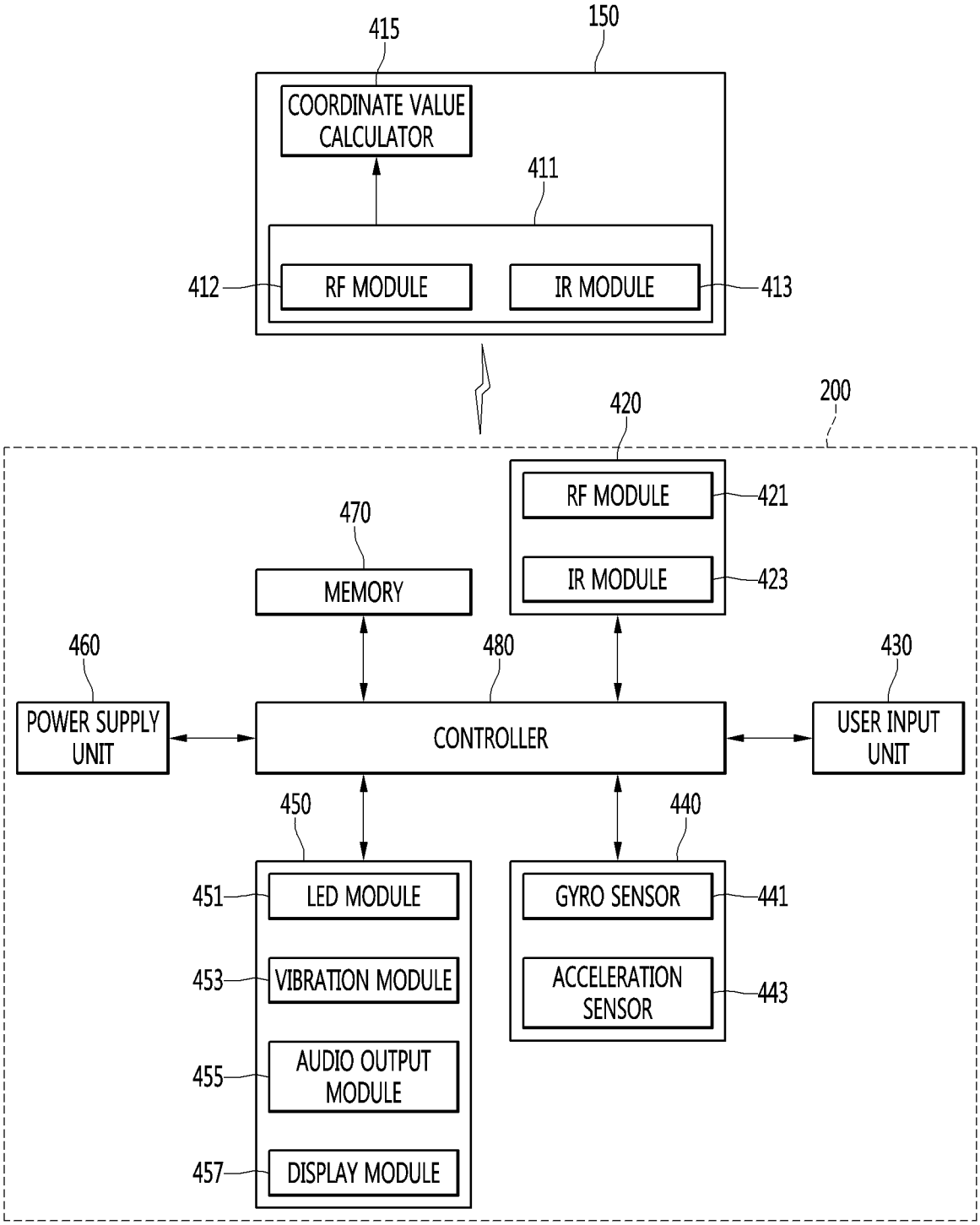
FIG. 4B is a block diagram of the inside of the remote controller in FIG. 2.

FIG. 4B is a block diagram of the inside of the remote controller in FIG. 2.

For description with reference to the drawings, the remote controller 200 includes a wireless communication unit 420, a user input unit 430, a sensor unit 440, an output unit 450, a power supply unit 460, a memory 470, and a controller 480.

The wireless communication unit 420 transmits and receives a signal to and from an arbitrary one of the image display apparatuses according to the embodiments of the present invention, which are described above. Of the image display apparatuses according to the embodiments of the present invention, one image display apparatus is taken as an example for description.

According to the present embodiment, the remote controller 200 includes an RF module 421 that transmits and receives a signal to and from the image display apparatus 100 in compliance with RF communication standards. In addition, the remote controller 200 includes an IR module 423 that possibly transmits and receives a signal to and from the image display apparatus 100 in compliance with IR communication standards.

According to the present embodiment, the remote controller 200 transfers a signal containing information on the movement of the remote controller 200 to the image display apparatus 100 through the RF module 421.

In addition, the remote controller 200 receives a signal transferred by the image display apparatus 100, through the RF module 421. In addition, the remote controller 200 transfers a command relating to power-on, power-off, a channel change, or a volume change, to the image display apparatus 100, through the IR module 423, whenever needed.

The user input unit 430 is configured with a keypad, buttons, a touch pad, a touch screen, or so on. The user inputs a command associated with the image display apparatus 100 into the remote controller 200 by operating the user input unit 430. In a case where the user input unit 430 is equipped with a physical button, the user inputs the command associated with the image display apparatus 100 into the remote controller 200 by performing an operation of pushing down the physical button. In a case where the user input unit 430 is equipped with a touch screen, the user inputs the command associated with the image display apparatus 100 into the remote controller 200 by touching on a virtual key of the touch screen. In addition, the user input unit 430 may be equipped with various types of input means operated by the user, such as a scroll key or a jog key, and the present embodiment does not impose any limitation on the scope of the present invention.

The sensor unit 440 includes a gyro sensor 441 or an acceleration sensor 443. The gyro sensor 441 senses information on the movement of the remote controller 200.

As an example, the gyro sensor 441 senses the information on operation of the remote controller 200 on the x-, y-, and z-axis basis. The acceleration sensor 443 senses information on the moving speed and so on of the remote controller 200. On the other hand, a distance measurement sensor is further included. Accordingly, a distance to the display 180 is sensed.

The output unit 450 outputs an image or an audio signal that corresponds to the operating of the user input unit 430 or corresponds to a signal transferred by the image display apparatus 100. Through the output unit 450, the user recognizes whether or not the user input unit 430 is operated or whether or not the image display apparatus 100 is controlled.

As an example, the output unit 450 includes an LED module 451, a vibration module 453, an audio output module 455, or a display module 457. The LED module 451, the vibration module 453, the audio output module 455, and the display module 457 emits light, generates vibration, outputs audio, or outputs an image, respectively, when the input unit 435 is operated, or a signal is transmitted and received to and from the image display apparatus 100 through a wireless communication unit 420.

The power supply unit 460 supplies a power to the remote controller 200. In a case where the remote controller 200 does not move for a predetermined time, the power supply unit 460 reduces power consumption by interrupting power supply. In a case where a predetermined key provided on the remote controller 200 is operated, the power supply unit 460 resumes the power supply.

Various types of programs, pieces of application data, and so on that are necessary for control or operation of the remote controller 200 are stored in the memory 470. In a case where the remote controller 200 transmits and receives a signal to and from the image display apparatus 100 in a wireless manner through the RF module 421, the signal is transmitted and received in a predetermined frequency band between the remote controller 200 and the image display apparatus 100. The controller 480 of the remote controller 200 stores information on, for example, a frequency band in which data is transmitted and received in a wireless manner to and from the image display apparatus 100 paired with the remote controller 200, in the memory 470, and makes a reference to the stored information.

The controller 480 controls all operations associated with the control by the remote controller 200. The controller 480 transfers a signal that corresponds to operating of a predetermined key of the user input unit 430, or a signal that corresponds to the movement of the remote controller 200, which is sensed in the sensor unit 440, to the image display apparatus 100 through the wireless communication unit 420.

A user input interface 150 of the image display apparatus 100 includes a wireless communication unit 411 that transmits and receives a signal in a wireless manner to and from the remote controller 200, and a coordinate value calculator 415 that calculates a coordinate value of the pointer, which corresponds to the operation of the remote controller 200.

The user input interface 150 transmits and receives the signal in a wireless manner to and from the remote controller 200 through the RF module 412. In addition, a signal transferred in compliance with the IR communication standards by the remote controller 200 through the IR module 413 is received.

The coordinate value calculator 415 calculates a coordinate value (x, y) of the pointer 205 to be displayed on the display 180, which results from compensating for a hand movement or an error, from a signal that corresponds to the operation of the remote controller 200, which is received through the wireless communication unit 411.

A transfer signal of the remote controller 200, which is input into the image display apparatus 100 through the user input interface 150 is transferred to the controller 170 of the image display apparatus 100. The controller 170 determines information on the operation of the remote controller 200 and information on operating of a key, from the signal transferred by the remote controller 200, and correspondingly controls the image display apparatus 100.

As another example, the remote controller 200 calculates a coordinate value of a pointer, which corresponds to the operation of the remote controller 200, and outputs the calculated value to the user input interface 150 of the image display apparatus 100. In this case, the user input interface 150 of the image display apparatus 100 transfers information on the received coordinate values of the pointer, to the controller 170, without performing a process of compensating for the hand movement and the error.

In addition, as another example, unlike in the drawings, it is also possible that the coordinate value calculator 415 is included within the controller 170 instead of the user input interface 150.

Figure 5:
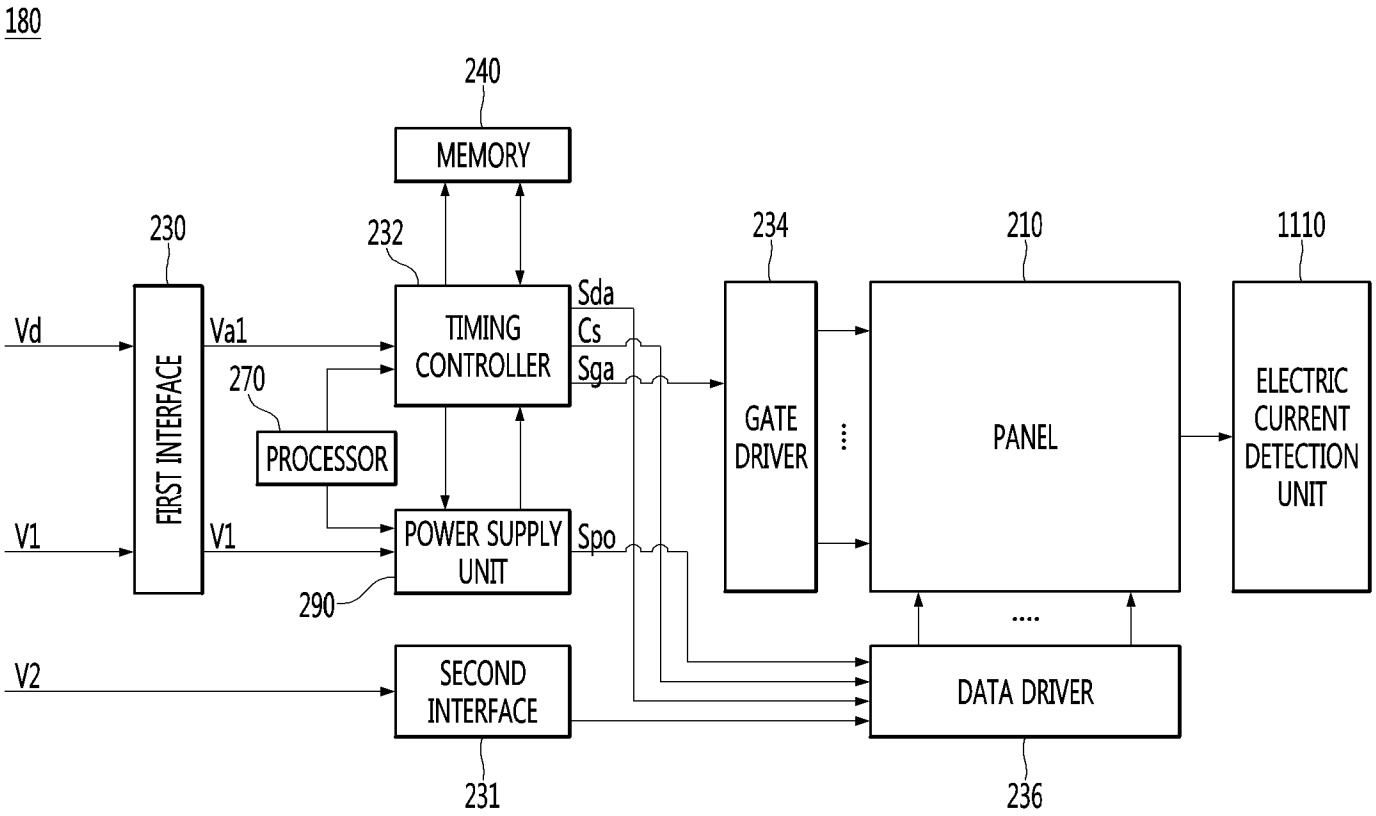
FIG. 5 is a block diagram of the inside of the display in FIG. 2.

FIG. 5 is a block diagram of the inside of the display in FIG. 2.

With reference with the drawings, the display 180 based on the organic light-emitting diode may include the OLED panel 210, a first interface 230, a second interface 231, a timing controller 232, a gate driver 234, a data driver 236, a memory 240, a processor 270, a power supply unit 290, an electric current detection unit 1110, and so on.

The display 180 receives an image signal Vd, a first direct current power V1, and a second direct current power V2. Based on the image signal Vd, the display 180 display a predetermined image is displayed.

On the other hand, the first interface 230 within the display 180 receives the image signal Vd and the first direct current power V1 from the controller 170.

At this point, the first direct current power V1 is used for operation for each of the power supply unit 290 and the timing controller 232 within the display 180.

Next, the second interface 231 receives the second direct current power V2 from the external power supply unit 190. On the other hand, the second direct current power V2 is input into the data driver 236 within the display 180.

Based on the image signal Vd, the timing controller 232 outputs a data drive signal Sda and a gate drive signal Sga.

For example, in a case where the first interface 230 converts the image signal Vd input, and outputs image signal val that results from the conversion, the timing controller 232 outputs the data drive signal Sda and the gate drive signal Sga based on the image signal val that results from the conversion.

The timing controller 232 further receives a control signal, the vertical synchronization signal Vsync, and so on, in addition to a video signal Vd from the controller 170.

The timing controller 232 outputs the gate drive signal Sga for operation of the gate driver 234 and the data drive signal Sda for operation of the data driver 236, based on the control signal, the vertical synchronization signal Vsync, and so on in addition to the video signal Vd.

In a case where the OLED panel 210 includes a subpixel for RGBW, the data drive signal Sda at this time is a data drive signal for a subpixel for RGBW.

On the other hand, the timing controller 232 further outputs a control signal Cs to the gate driver 234.

The gate driver 234 and the data driver 236 supplies a scanning signal and an image signal to the OLED panel 210 through a gate line GL and a data line DL according to the gate drive signal Sga and the data drive signal Sda, respectively, from the timing controller 232. Accordingly, a predetermined image is displayed on the OLED panel 210.

On the other hand, the OLED panel 210 includes an organic light-emitting layer. In order to display an image, many gate lines GL and many data lines DL are arranged to intersect each other in a matrix form, at each pixel that corresponds to the organic light-emitting layer.

On the other hand, the data driver 236 outputs a data signal to the OLED panel 210 based on the second direct current power V2 from the second interface 231.

The power supply unit 290 supplies various types of powers to the gate driver 234, the data driver 236, the timing controller 232, and so on.

The electric current detection unit 1110 detects an electric current that flows through a subpixel of the OLED panel 210. The electric current detected is input into the processor 270 and or so for accumulated electric-current computation.

The processor 270 performs various types of control within the display 180. For example, the gate driver 234, the data driver 236, the timing controller 232, and so on are controlled.

On the other hand, the processor 270 receives information of the electric current that flows through the subpixel of the OLED panel 210, from the electric current detection unit 1110.

Then, based on the information of the electric current that flows through the subpixel of the OLED panel 210, the processor 270 computes an accumulated electric current of a subpixel of each organic light-emitting diode (OLED) panel 210. The accumulated electric current computed is stored in the memory 240.

On the other hand, in a case where the accumulated electric current of the subpixel of each organic light-emitting diode (OLED) panel 210 is equal to or greater than an allowed value, the processor 270 determines the subpixel as a burn-in subpixel.

For example, in a case where the accumulated electric current of the subpixel of each organic light-emitting diode (OLED) panel 210 is 300000 A or higher, the subpixel is determined as a burn-in subpixel.

On the other hand, in a case where, among subpixels of each organic light-emitting diode (OLED) panel 210, an accumulated electric current of one subpixel approaches the allowed value, the processor 270 determines the one subpixel as expected to be a burn-in subpixel.

On the other hand, based on the electric current detected in the electric current detection unit 1110, the processor 270 determines a subpixel that has the highest accumulated electric current, as expected to be a burn-in subpixel.

Figure 6A:
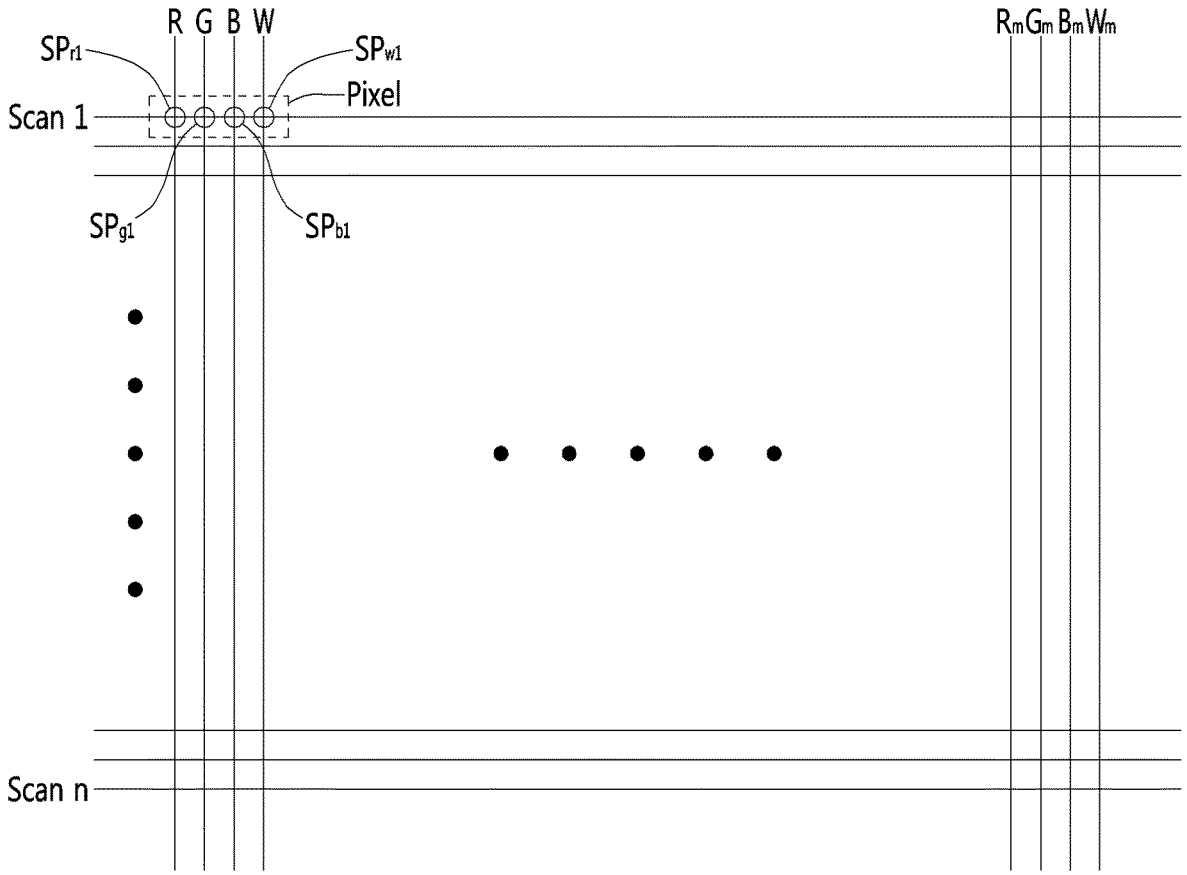
FIGS. 6A and 6B are diagrams that are referred to for description of the OLED panel in FIG. 5.
Figure 6B:
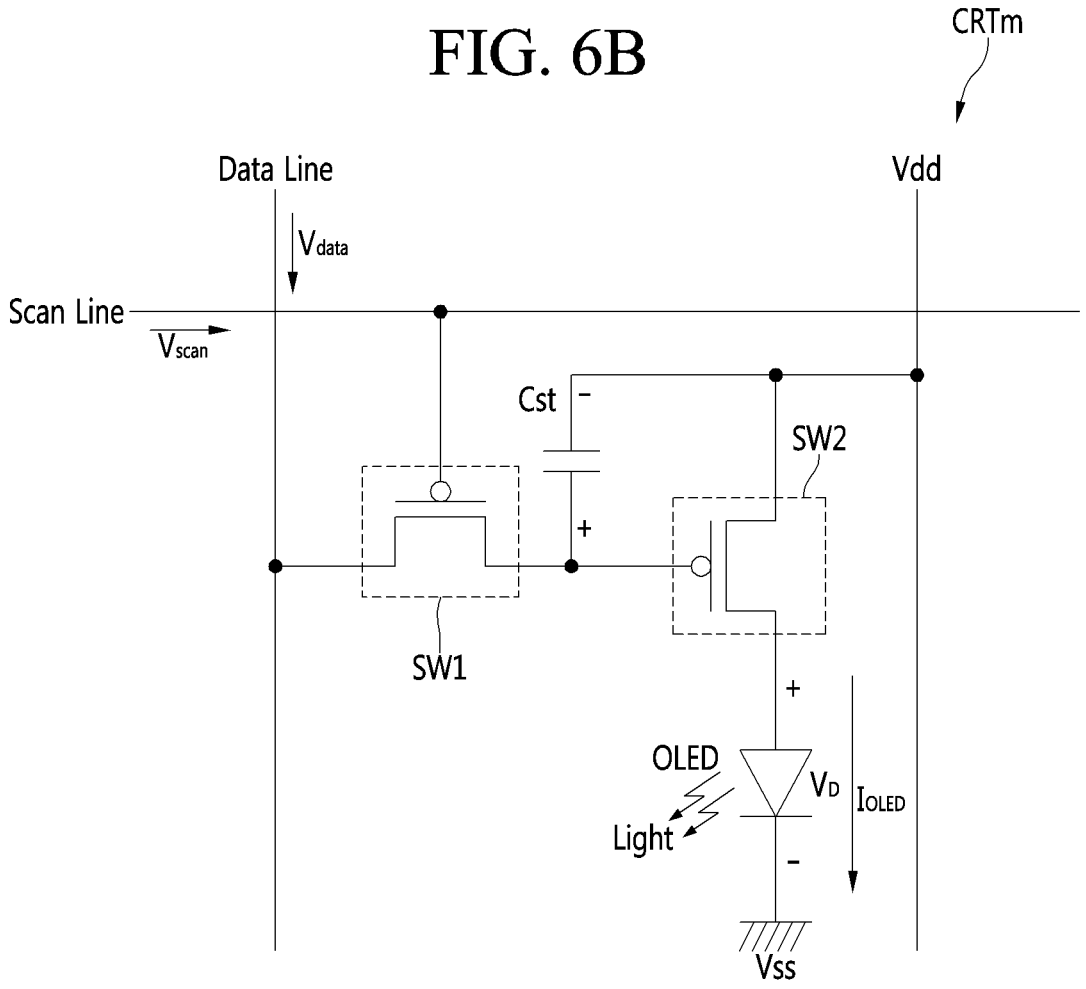

FIGS. 6A and 6B are diagrams that are referred to for description of the OLED panel in FIG. 5.

First, FIG. 6A is a diagram illustrating a pixel within the OLED panel 210.

With reference to the drawings, the OLED panel 210 includes a plurality of scan lines Scan 1 to Scan n and a plurality of data lines R1, G1, B1, W1 to Rm, Gm, Bm, Wm that intersect a plurality of scan lines Scan 1 to Scan n, respectively.

On the other hand, an area where the scan line and the data line within the OLED panel 210 intersect each other is defined as a subpixel. In the drawings, a pixel that includes a subpixel $SP_{r1}$, $SP_{g1}$, $SP_{b1}$, $SP_{w1}$ for RGBW is illustrated.

FIG. 6B illustrates a circuit of one subpixel within the OLED panel in FIG. 6A.

With reference to the drawings, an organic light-emitting subpixel circuit CRTm includes a switching element SW1, a storage capacitor Cst, a drive switching element SW2, and an organic light-emitting layer (OLED), which are active-type elements.

A scan line is connected to a gate terminal of the scan switching element SW1. The scanning switching element SW1 is turned on according to a scan signal Vscan input. In a case where the scan switching element SW1 is turned on, a data signal Vdata input is transferred to the gate terminal of the scan switching element SW2 or one terminal of the storage capacitor Cst.

The storage capacitor Cst is formed between the gate terminal and a source terminal of the drive switching element SW2. A predetermined difference between a data signal level transferred to one terminal of the storage capacitor Cst and a direct current (Vdd) level transferred to the other terminal of the storage capacitor Cst is stored in the storage capacitor Cst.

For example, in a case where data signals have different levels according to a pulse amplitude modulation (PAM) scheme, power levels that are stored in the storage capacitor Cst are different according to a difference between levels of data signals Vdata.

As another example, in a case where data signals have different pulse widths according to a pulse width modulation (PWM) scheme, power levels that are stored in the storage capacitor Cst are different according to a difference between pulse widths of data signals Vdata.

The drive switching element SW2 is turned on according to the power level stored in the storage capacitor Cst. In a case where the drive switching element SW2 is turned on, a drive electric current ($I_{OLED}$), which is in proportion to the stored power level, flows through the organic light-emitting layer (OLED). Accordingly, the organic light-emitting layer (OLED) performs a light-emitting operation.

The organic light-emitting layer (OLED) includes a light-emitting layer (EML) for RGBW, which corresponds to a subpixel, and includes at least one of the following layers: a hole implementation layer (HIL), a hole transportation layer (HTL), an electron transportation layer (ETL), and an electron implementation layer (EIL). In addition to these, the organic light-emitting layer includes a hole support layer and so on.

On the other hand, when it comes to a subpixel, the organic light-emitting layer outputs while light, but in the case of the subpixels for green, red, and blue, a separate color filter is provided in order to realize color. That is, in the case of the subpixels for green, red, and blue, color filters for green, red, and blue, respectively, are further provided. On the other hand, in the case of the subpixel for white, white light is output and thus a separate color filter is unnecessary.

On the other hand, in the drawings, as the scan switching element SW1 and the drive switching element SW2, p-type MOSFETs are illustrated, but it is also possible that n-type MOSFETs, or switching elements, such as JETs, IGBTs, or SICs, are used.

On the other hand, the controller 170 may perform automatic current limit (ACL) so that the luminance of the image is limited to be not higher than a predetermined luminance.

Here, the automatic current limit (ACL) may be a method for lowering the luminance of the overall screen by determining an average picture level (APL) of the OLED panel 210 by summing the total data values for displaying a video on the OLED panel 210, adjusting the light emitting period according to the level of the average picture level, or controlling the driving current by changing the video data itself.

On the other hand, when the driving current supplied to the the OLED panel 210 is high, the temperature of the display 180 may become excessively high.

In particular, even if the controller 170 limits the maximum value of the current supplied to the OLED panel 210 by performing the automatic current limit (ACL) to the current limit value, the current supplied to the OLED panel 210 may be maintained at the current limit value for a predetermined time or longer according to the characteristics of the output video. In this case, the temperature of the OLED panel 210 may be excessively high. For example, the characteristics of the output video may include a case where the output image includes a plurality of secondary colors or tertiary colors, such as animation, a case where a video mode is a vivid mode, and the like.

The image display apparatus 100 according to the present invention can adjust the current limit value based on the information about the current supplied to the OLED panel 210.

Figure 7:
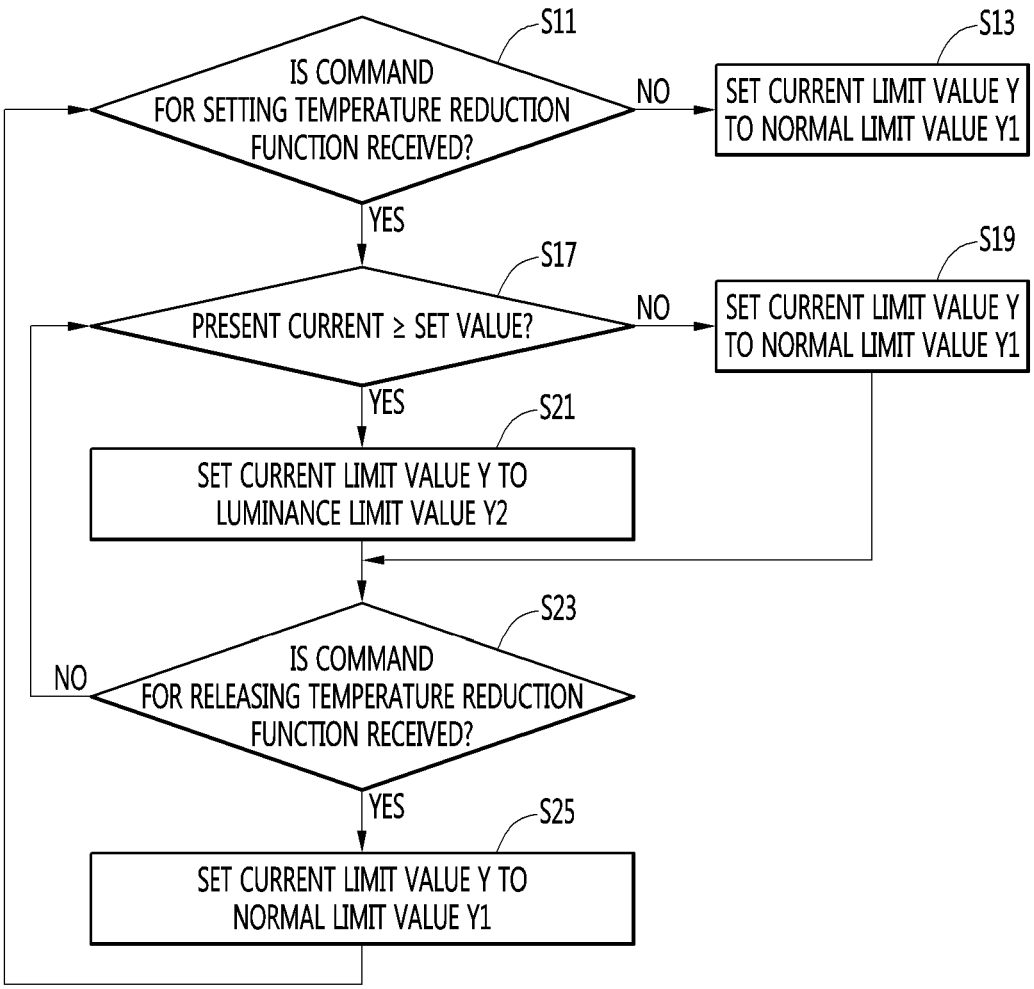
FIG. 7 is a flowchart of an operating method of the image display apparatus according to a first embodiment of the present invention.
Figure 8:
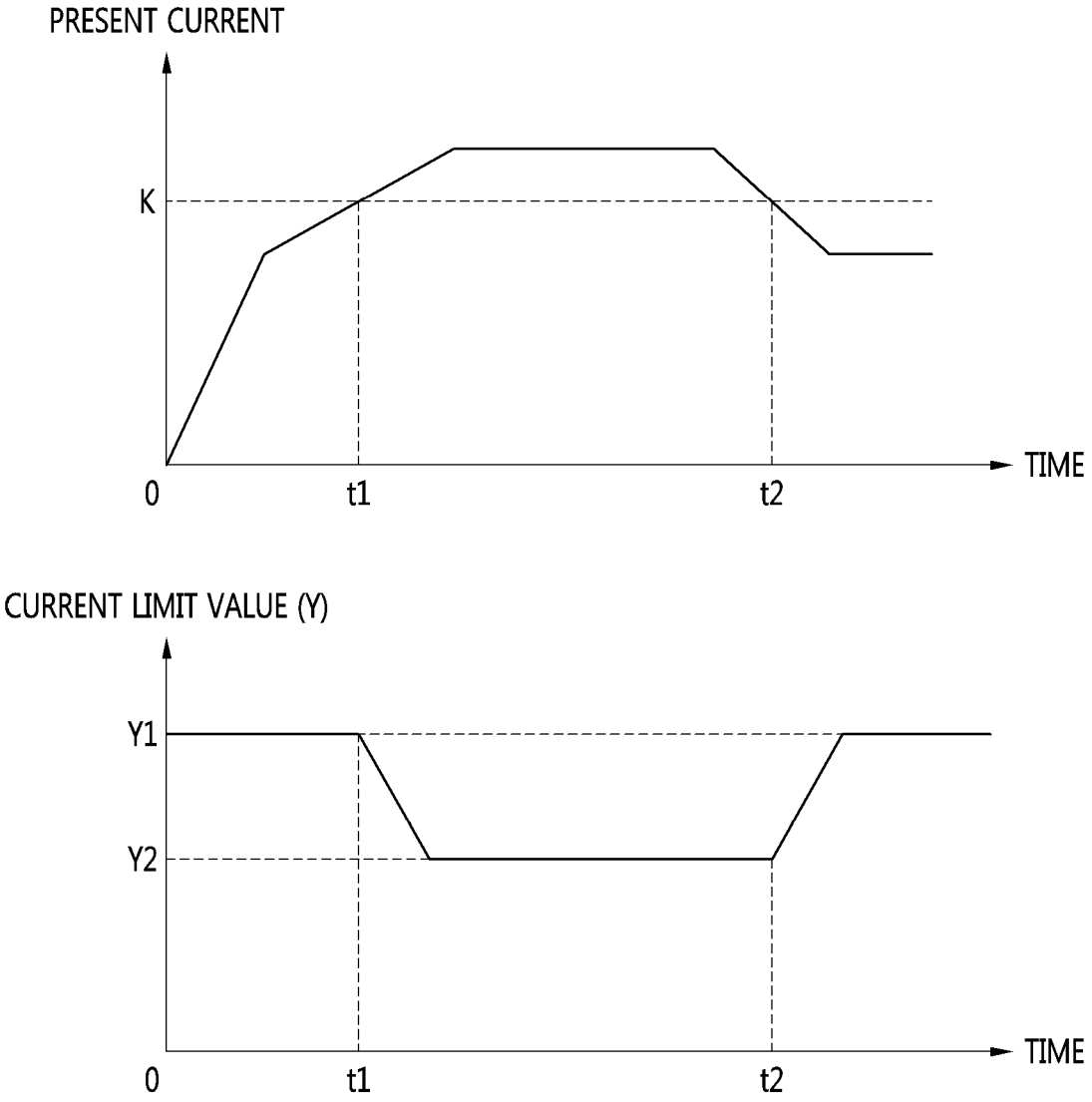
FIG. 8 is a graph showing a state in which the image display apparatus according to a first embodiment of the present invention is operated.

FIG. 7 is a flowchart of an operation method of an image display apparatus according to a first embodiment of the present invention, and FIG. 8 is an exemplary graph showing the operation of the display apparatus according to the first embodiment of the present invention.

The controller 170 may determine whether a command for setting the temperature reduction function is received (S11).

The controller 170 may determine whether the command for setting the temperature reduction function has been received. However, it is understood that this step is optional. For example, alternatively or in addition, the controller 170 may determine that the temperature reduction function has to be set/enabled. This may be caused due to external factors, e.g. the temperature of the room where the display device is located, or internal factors, e.g. preventing overheating of the display device. In other words, steps S11 and S12 are to be considered optional. In addition or alternatively, the controller 170 may receive a command, e.g. from another entity or a sever, e.g. through the network interface unit 133 and/or the external device interface unit 135 that the temperature reduction function is to be enabled/set and the controller 170 then sets/enables the temperature reduction function accordingly.

The user may set the temperature reduction function of the image display apparatus 100, or may release the temperature reduction function of the image display apparatus 100.

The controller 170 may receive the command for setting the temperature reduction function or the command for releasing the temperature reduction function through the interface unit 150 as a user input.

Here, the temperature reduction function may mean a function of reducing the temperature of the OLED panel 210 by adjusting the current limit value indicating the maximum value of the current supplied to the OLED panel 210. When the temperature reduction function is set, the current limit value may be changed, and when the temperature reduction function is released, the current limit value may be fixed. In other words, the current limit value may be fixed when the temperature reduction function is released. The current limit value may not be changed when the temperature reduction function is released.

For example, the current limit value Y is fixed at Y1 during the release of the temperature reduction function.

The controller 170 may adjust the current limit value Y when the temperature reduction function is set, and may fix the current limit value Y when the temperature reduction function is released.

If the controller 170 does not receive the command for setting the temperature reduction function, the current limit value Y may be set to a normal limit value Y1 (S13). The normal limit value is also referred to as the first limit value in the present disclosure.

Here, the current limit value Y may mean the maximum value of the current that can be supplied to the OLED panel 210 per frame by the automatic current limit.

In the present invention, the case where the current limit value Y is set to the normal limit value Y1 or the luminance limit value Y2 has been described, but this is merely an example, and the present invention is not limited thereto. The luminance, i.e. the luminous intensity per unit area, may be directly related to the current/current density needed for the panel. That is, the current limit value Y may be set to any one of two or more different current values. The luminance limit value is also referred to as the second limit value in the present disclosure.

The controller 170 may determine whether the current is equal to or greater than a predetermined value (S17).

The controller 170 may acquire the present current supplied to the OLED panel 210 at each predetermined period.

Specifically, the controller 170 may receive the information about the current supplied to the OLED panel 210 per frame based on the R, G, and B data signals output by the timing controller 186 and acquire the present current.

The set value is a value to be used as a reference for changing the current limit value Y, and may be preset when the image display apparatus 100 is installed. The set value may be changed and set by the specification of the image display apparatus 100, a user command, or the like. The set value is also referred to as the third limit value in the present disclosure.

When the present current is less than the set value, the controller 170 may set the current limit value Y to the normal limit value Y1 (S19).

When the current is greater than the set value, the controller 170 may set the current limit value Y to the luminance limit value Y2 that is lower than the normal limit value Y1 (S21).

The luminance of the video when the current limit value Y is set to the luminance limit value Y2 may be lower than the luminance of the video when the current limit value Y is set to the normal limit value Y1.

The controller 170 may set the current limit value Y to the normal limit value Y1 in the first state in which the temperature reduction function is released or in the second state in which the current reduction function is set but the present current is less than the set value, and may set the current limit value Y to the luminance limit value Y2 lower than the normal limit value Y1 in the third state in which the current reduction function is set but the present current is equal to or higher than the set value.

On the other hand, unlike in FIG. 7, the controller 170 may set the current limit value Y to the normal limit value Y1 in the first state in which the temperature reduction function is released, may set the current limit value Y1 to the normal limit value Y1 in the second state in which the temperature reduction function is set but the present current is less than the set value, and may set the current limit value Y to the second luminance limit value (not illustrated) less than the first luminance limit value (not illustrated) in the third state in which the temperature reduction function is set but the present current is equal to or greater than the set value.

The controller 170 may determine whether the command for releasing the temperature reduction function is received (S23).

The controller 170 may determine whether the command for releasing the temperature reduction function has been received while the temperature reduction function is being set.

Like the command for setting the temperature reduction function, the controller 170 may receive the command for releasing the temperature reduction function through the interface unit 150 as the user input.

When the controller 170 does not receive the command for releasing the temperature reduction function, the controller 170 may return to step S17.

That is, the controller 170 may measure the present current periodically while the temperature reduction function is set, compare the measured present current with the set value, and set the current limit value Y to the normal limit value Y1 or the luminance limit value Y2.

On the other hand, when the command for releasing the temperature reduction function is received, the controller 170 may set the current limit value Y to the normal limit value Y1 (S25).

That is, when the temperature reduction function is released, the controller 170 may set the current limit value Y to the normal limit value Y1, regardless of the present current. However, the normal limit value Y1 is merely an example. When the temperature reduction function is released, the controller 170 may fix the current limit value Y to a value in a range between the normal limit value Y1 and the luminance limit value Y2.

The current limit value Y set in step S13 and the current limit value Y set in step S25 may be equal to each other.

Referring to the example of FIG. 8, in the $1^{st}$ time interval (0 to t1), the temperature reduction function is released or the temperature reduction function is set, but the present current may be lower than the set value K. In this case, the current limit value Y may be the normal current value Y1. In the $2^{nd}$ time interval (t1 to t2), the temperature reduction function is set and the present current is higher than the set value K. The current limit value Y may be the luminance limit value Y2. In the $3^{rd}$ time interval (t2 or more), the temperature reduction function is released or the temperature reduction function is set, but the present current is lower than the set value K. The current limit value Y may be changed from the luminance limit value Y2 to the normal current value Y1.

At this time, in the time point t1 and t2 when the current limit value Y changes, the current limit value Y may gradually decrease from the normal current value Y1 to the luminance limit value Y2, or may gradually increase from the luminance limit value Y2 to the normal current value Y1. That is, the current limit value Y may be decreased by a predetermined ratio or increased by a predetermined ratio. In this case, it is possible to minimize the rapid change of the luminance of the output video, thereby minimizing the sense of heterogeneity felt by the user.

As described with reference to FIGS. 7 and 8, when the current limit value Y is set to the luminance limit value Y2, the current supplied to the OLED panel 210 is lower than when the current limit value Y1 is set to the normal limit value Y1, thereby further lowering the temperature of the OLED panel 210. That is, according to the first embodiment of the present invention, the temperature of the OLED panel 210 may be reduced by comparing the set current value with the present current supplied to the OLED panel 210, and the algorithm of the temperature reduction function may be simplified.

Figure 9:
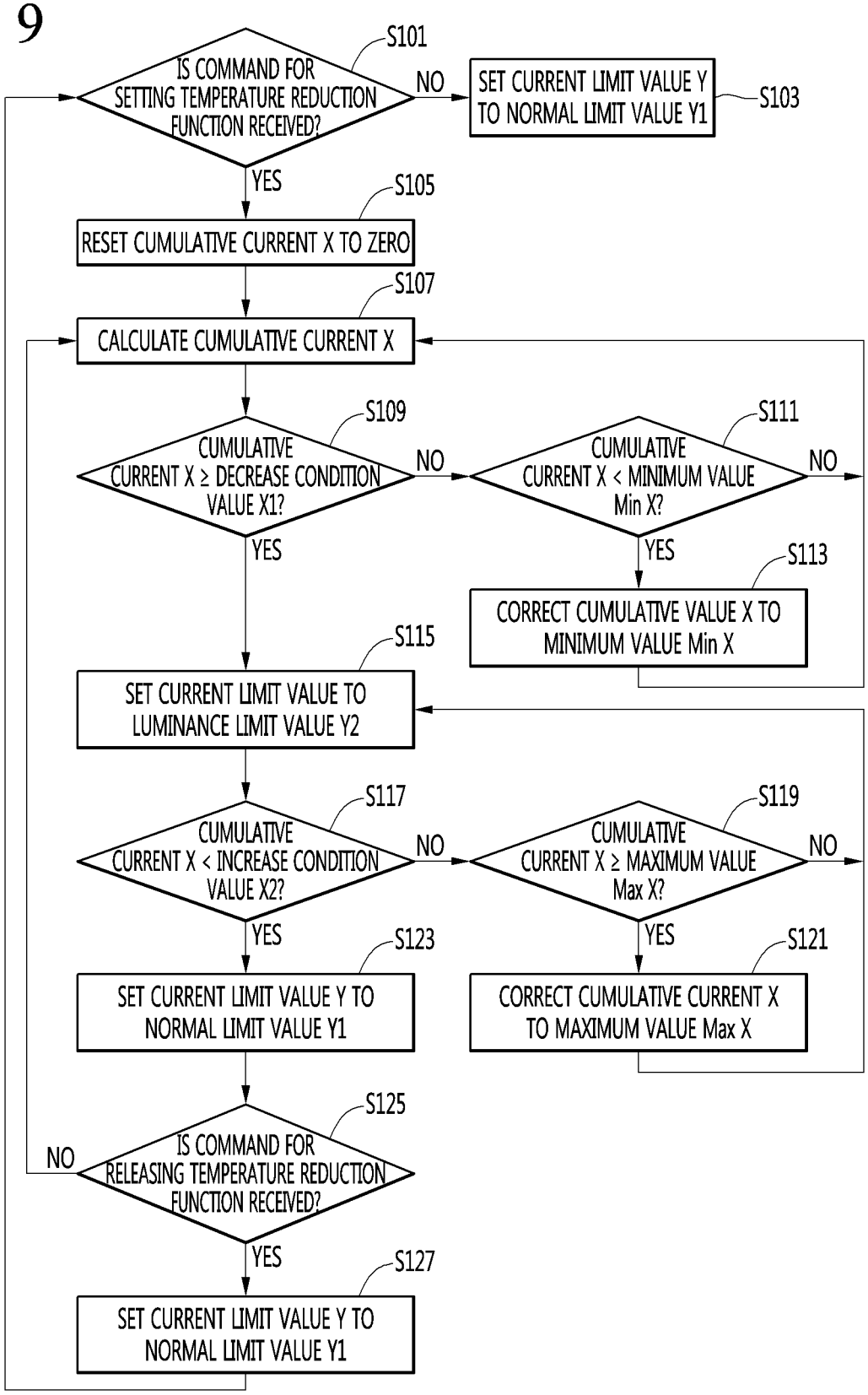
FIG. 9 is a flowchart of an operating method of the image display apparatus according to a second embodiment of the present invention.
Figure 10:
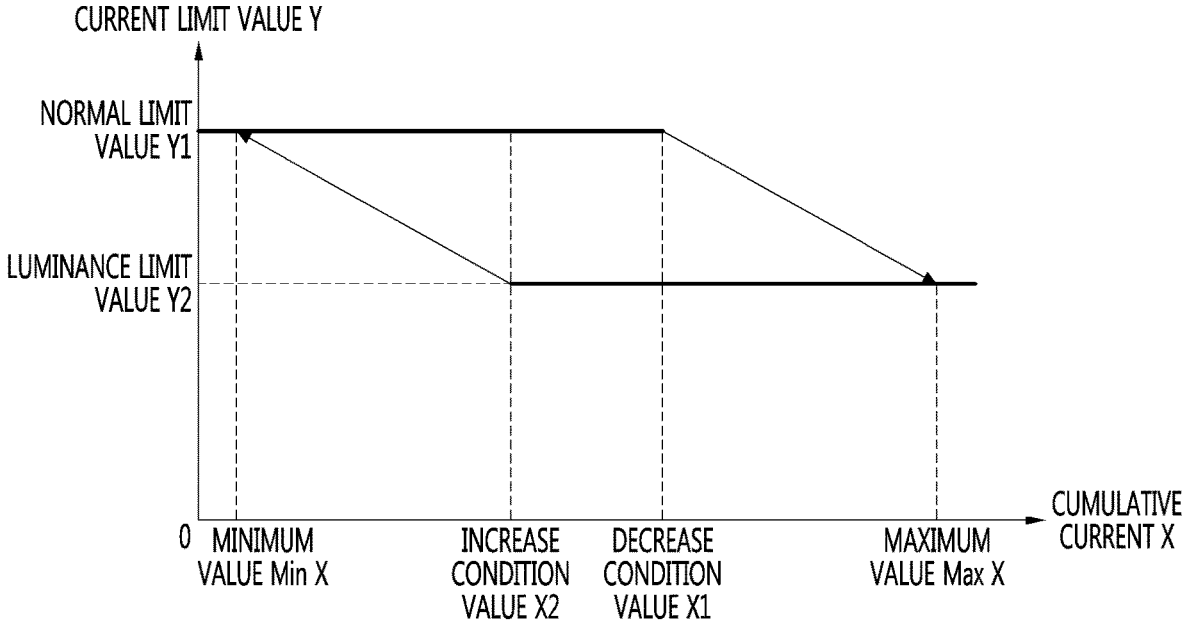
FIG. 10 is a graph showing a relationship between a cumulative current (X) and a current limit value (Y) according to a second embodiment of the present invention.

FIG. 9 is a flowchart of an operating method of an image display apparatus according to a second embodiment of the present invention, FIG. 10 is a graph showing a relationship between a cumulative current (X) and a current limit value (Y) according to a second embodiment of the present invention, and FIGS. 11 to 14 are graphs showing a state in which an image display apparatus according to a second embodiment of the present invention is operated.

The controller 170 may determine whether the command for setting the temperature reduction function is received (S101). As already noted above, the determination whether the command for setting the temperature reduction function is received is optional and the controller may set/enable the temperature reduction function.

This is the same as that described in step S11 of FIG. 7, and thus a detailed description thereof will be omitted.

When the controller 170 does not receive the command for setting the temperature reduction function, the controller 170 may set the current limit value Y to the normal limit value Y1 (S103).

As described in step S13 of FIG. 7, although the case where the current limit value Y is one of the normal limit value Y1 and the luminance limit value Y2 has been described, this is merely an example, and the current limit value Y1 may be set to any one of two or more different current values.

When the controller 170 does not receive the command for setting the temperature reduction function, the controller 170 may set the current limit value Y to the normal limit value Y1 (S103).

The normal limit value Y1 may be the largest value among the settable current limit values Y. The normal limit value Y1 may vary depending on the specification of the image display apparatus 10 and the like.

When the command for setting the temperature reduction function is received, the controller 170 may reset the cumulative current X to zero (S105).

When switching from the released state of the temperature reduction function to the set state of the temperature reduction function, the controller 170 may reset the cumulative current X to zero. Therefore, it is possible to minimize the case where the performance of the temperature reduction function according to the cumulative current X calculated last when the temperature reduction function is previously set, thereby improving the reliability thereof.

In addition, the controller 170 sets the current limit value Y to the normal limit value Y1 when the temperature reduction function is released. Therefore, when the command for setting the temperature reduction function is received in a state in which the temperature reduction function is released, the current limit value Y may be set to the normal limit value Y1.

According to the embodiment, the controller 170 may reset the current limit value Y to the normal limit value Y1 when the cumulative current X is reset to zero.

After resetting the cumulative current x to zero, the controller 170 may calculate the cumulative current X (S107).

The controller 170 may calculate the cumulative current X based on the information about the current supplied to the OLED panel 210. Preferably, the controller 170 may calculate the cumulative current X by summing the differences between the present current supplied to the OLED panel 210 and a reference current value. More preferably, the present current supplied to the panel 181 may be constantly monitored for a certain period of time, e.g. with a given sampling rate, i.e. at given sampling points. Even more preferably, the present current supplied to the panel 181 may be constantly monitored for a certain period of time, e.g. with a given sampling rate, during the temperature reduction function is set. Preferably, the controller 170 may calculate the cumulative current X by summing the differences between the present current supplied to the panel 181 at the given sampling points and the reference current value.

The present current is a current value supplied to the OLED panel 210 for outputting the current frame, and may be calculated based on the R, G, and B data signals output by the timing controller 186.

The reference value is a value set to determine whether the present current is high or low, and may vary depending on the specification of the image display apparatus 100.

The reference value may be less than or equal to the minimum value among the settable current limit values Y. The reference value may be less than the luminance limit value Y2.

The controller 170 may acquire the difference d between the present current and the reference value at each set period and may calculate the cumulative current X by summing the obtained differences. That is, the controller 170 may acquire the difference d between the present current and the reference value at each set period, e.g. according to Equation 1, and may calculate the cumulative current X by summing the difference d obtained according to Equation 2 below and the immediately previous cumulative current X−1.

$$\text{Difference}(d)=\text{Present Current}-\text{Reference Value} \quad \text{[Equation 1]}$$

$$\text{Cumulative Current}(X)=\text{Immediately Previous Cumulative Current}(X-1)+\text{Difference}(d) \quad \text{[Equation 2]}$$

Here, the set period may be 30 seconds, but this is merely an example, and the present invention is not limited thereto. In other words, the difference may be calculated for the period of time, e.g. 30 seconds, e.g. with a given sampling rate.

Preferably, controller is configured to calculate the cumulative current X at a certain instance of time T by summing the difference between a present current supplied to the panel and a reference value at the certain time T and the cumulative current at the immediately previous instance of time T−1.

After the cumulative current X is calculated, the controller 170 may determine whether the calculated cumulative current X is equal to or greater than a decrease condition value X1 (S109).

Here, the decrease condition value may be a cumulative current value that serves as a reference for decreasing the current limit value Y.

As illustrated in FIG. 10, when the cumulative current X is equal to or greater than the decrease condition value X1 in a state in which the current limit value Y is set to the normal limit value Y1, the controller 170 may change the current limit value Y from the normal limit value Y1 to the luminance limit value Y2.

On the other hand, when the cumulative current X is less than the decrease condition value X1 in the state in which the current limit value Y is set to the normal limit value Y1, the current limit value Y may be maintained at the normal limit value Y1.

When the cumulative current X is equal to or greater than the decrease condition value X1, the controller 170 may set the current limit value Y to the luminance limit value Y2 (S115).

In this case, the luminance limit value Y2 may be less than the normal limit value Y1.

When the cumulative limit current X is equal to or greater than the decrease condition value X1 in a state in which the current limit value Y is set to the normal limit value Y1, the controller 170 may reduce the current limit value Y from the normal limit value Y1 to the luminance limit value Y2.

That is, the controller 170 may determine that the temperature of the OLED panel 210 is equal to or higher than the reference temperature when the cumulative current X is equal to or greater than the decrease condition value X1, may set the current limit value Y to be less than the currently set value, and may reduce the current supplied to the OLED panel 210.

At this time, the controller 170 may reduce the current limit value Y by a preset ratio at each predetermined time. That is, the controller 170 may gradually decrease the current limit value Y to minimize the sense of heterogeneity that the user feels due to the abrupt change in the video luminance.

On the other hand, when the cumulative current X is less than the decrease condition value X1, the controller 170 may maintain the current limit value Y at the normal limit value Y1.

That is, when the cumulative current X is less than the decrease condition value X1, the controller 170 may determine that the OLED panel 210 is not overheated and may maintain the luminance of the current video.

When the cumulative current X is less than the decrease condition value X1, the controller 170 may determine whether the cumulative current X is less than a minimum value Min X (S111), and when the cumulative current X is less than the minimum value Min X, the controller 170 may correct the cumulative current X to the minimum value Min X (S113).

On the other hand, when the cumulative current X is equal to or greater than the minimum value Min X, the controller 170 may maintain the present cumulative current X and may return to step S107.

Here, the minimum value Min X means the smallest value among the cumulative currents X that can be calculated, and may be a value set for limiting the unlimited decrease of the cumulative current X.

When the cumulative current X is continuously lowered in a state in which the current limit value Y is set to the normal limit value Y1, even if the high current is supplied to the OLED panel 210, the time required until the cumulative current X is calculated to be equal to or greater than the decrease condition value X1 may be prolonged, and the OLED panel 210 may be overheated for that time. Therefore, in the present invention, when the minimum value of the cumulative current X is limited and the cumulative current X is less than the predetermined minimum value Min X, the cumulative current X may be corrected to the minimum value Min X.

For example, the minimum value Min X may be 0, and when the cumulative current X is calculated to be less than 0 (for example, −2), the controller 170 may correct the cumulative current X from −2 to 0. Here, the values are given as dimensionless quantities for ease of simplicity but is understood by the skilled person and within his/her customary practice to chose an appropriate unit, e.g. Ampere.

On the other hand, when the current limit value Y is changed from the normal limit value Y1 to the luminance limit value Y2, the controller 170 may determine whether the cumulative current X is less than the increase condition value X2 (S117).

Here, the increase condition value may be a cumulative current value that serves as a reference for increasing the current limit value Y.

As illustrated in FIG. 10, when the cumulative current X is less than the increase condition value X2 in a state in which the current limit value Y is set to the luminance limit value Y2, the controller 170 may change the current limit value Y from the luminance limit value Y2 to the normal limit value Y1.

On the other hand, when the cumulative current X is equal to or greater than the increase condition value X2 in the state in which the current limit value Y is set to the luminance limit value Y2, the current limit value Y may be maintained at the luminance limit value Y2.

The increase condition value X2 may be less than the decrease condition value X1.

When the cumulative current X is less than the increase condition value X2, the controller 170 may set the current limit value Y to the normal limit value Y1 (S123).

When the cumulative limit current X is less than the increase condition value X2 in a state in which the current limit value Y is set to the luminance limit value Y2, the controller 170 may increase the current limit value Y from the luminance limit value Y2 to the normal limit value Y1.

That is, the controller 170 may determine that the temperature of the OLED panel 210 is lower than the reference temperature when the cumulative current X is less than the increase condition value X2, may set the current limit value Y to be larger than the currently set value, and may increase the current supplied to the OLED panel 210 and increase the luminance of the video.

At this time, the controller 170 may increase the current limit value Y by a preset ratio at each predetermined time. That is, the controller 170 may gradually increase the current limit value Y to minimize the sense of heterogeneity that the user feels due to the abrupt change in the video luminance.

On the other hand, when the cumulative current X is equal to or greater than the increase condition value X2, the controller 170 may maintain the current limit value Y at the luminance limit value Y2.

That is, when the cumulative current X is equal to or greater than the increase condition value X2, the controller 170 may determine that the temperature of the OLED panel 210 is still high and may maintain a low luminance.

In addition, when the cumulative current X is greater than the increase condition value X2, the controller 170 may determine whether the cumulative current X is equal to or greater than a maximum value Max X (S119), and when the cumulative current X is equal to or greater than the maximum value Max X, the controller 170 may correct the cumulative current X to the maximum value Max X (S121).

On the other hand, when the cumulative current X is less than the maximum value Max X, the controller 170 may maintain the present cumulative current X.

Here, the maximum value Max X means the greatest value among the cumulative currents X that can be calculated, and may be a value set for limiting a potential unlimited increase of the cumulative current X.

When the cumulative current X is continuously increased in a state where the current limit value Y is set to the luminance limit value Y2, even if the low current is supplied to the OLED panel 210, the time required until the cumulative current X is calculated to be less than the increase condition value X2 may be prolonged. In this case, even when the temperature of the OLED panel 210 is lowered, the luminance of the video may not be rapidly recovered. Therefore, in the present invention, when the maximum value of the cumulative current X is limited and the cumulative current X is equal to or greater than the predetermined maximum value Max X, the cumulative current X may be corrected to the maximum value Max X.

For example, the maximum value Max X may be 25, and when the cumulative current X is calculated to be equal to or greater than 25 (for example, 28), the controller 170 may correct the cumulative current X from 28 to 25.

On the other hand, after the controller 170 changes the current limit value Y from the luminance limit value Y2 to the normal limit value Y1, the controller 170 may determine whether the command for releasing the temperature reduction function is received (S125).

Unlike the case illustrated in FIG. 9, the controller 170 may determine whether the command for releasing the temperature reduction function has been continuously received while the temperature reduction function is being set.

When the command for releasing the temperature reduction function is received, the controller 170 may set the current limit value Y to the normal limit value Y1 (S127), and may return to step S101.

That is, when the command for releasing the temperature reduction function is received, the controller 170 may set the current limit value Y to the normal limit value Y1, regardless of the cumulative current X. However, the normal limit value Y1 is merely an example. When the temperature reduction function is released, the controller 170 may fix the current limit value Y to a value in a range between the normal limit value Y1 and the luminance limit value Y2.

On the other hand, when the current limit value Y is changed from the luminance limit value Y2 to the normal limit value Y1 without receiving the command for releasing the temperature reduction function, the controller 170 may periodically calculate the cumulative current X and determine whether the cumulative current X is equal to or greater than the decrease condition value X1.

The cumulative current calculating method and the current limit value setting method according to the second embodiment of the present invention will be described in detail with reference to FIGS. 11 to 14. In FIGS. 11 to 14, the normal limit value Y1 is 14, the luminance limit value Y2 is 10, and the reference value is 9, but this is merely an example, and the present invention is not limited thereto t1, t2, . . . , and t24 illustrated in FIGS. 11 to 14 may be the time at which the cumulative current X according to the set period is calculated.

Figure 11:
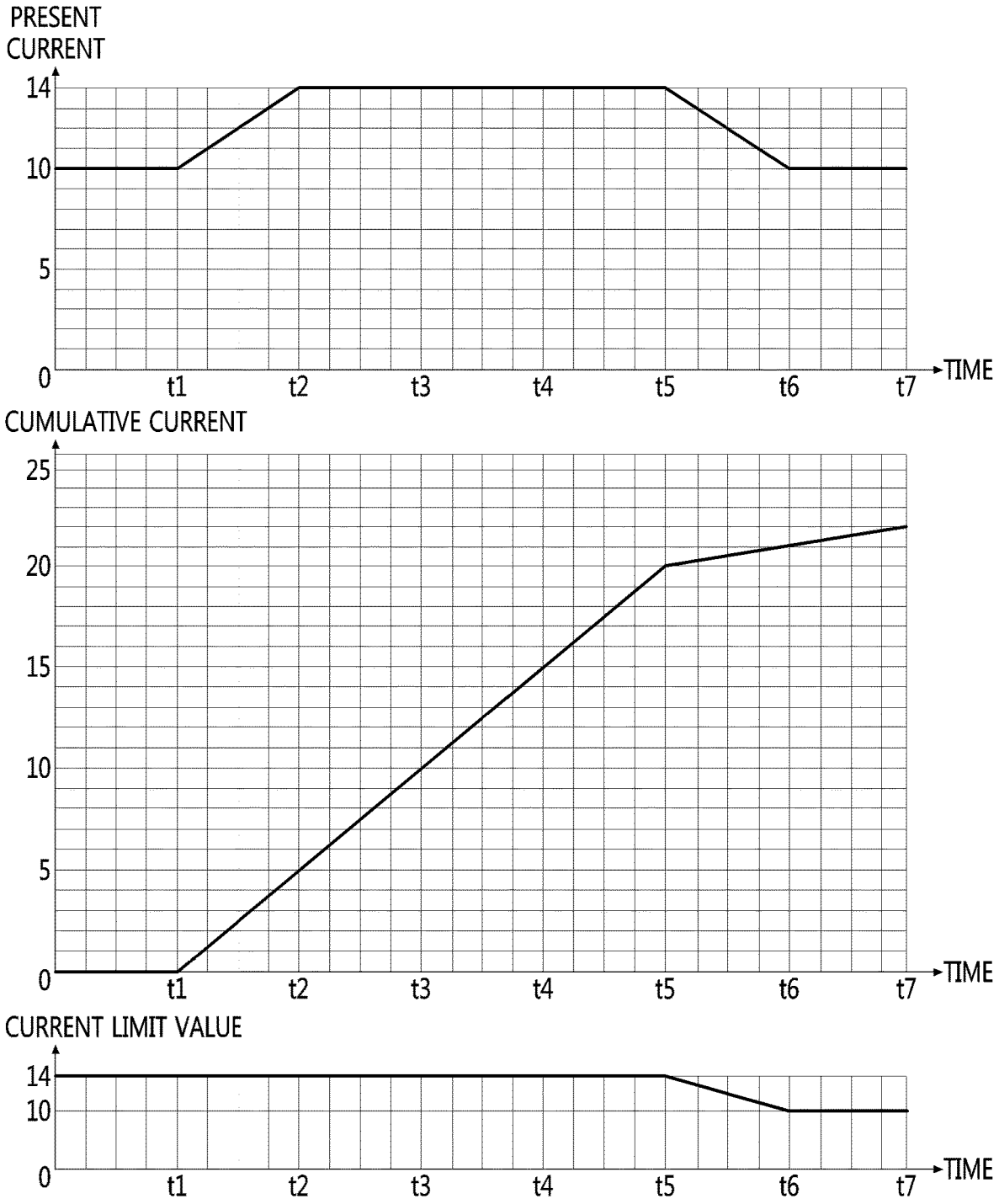
FIGS. 11 to 14 are graphs showing a state in which the image display apparatus according to a second embodiment of the present invention is operated.

Referring to FIGS. 11, 0 to t1 may be a state in which the temperature reduction function is released. According to one embodiment, when the temperature reduction function is released, the controller 170 may control the cumulative current X to be zero, regardless of the present current. According to another embodiment, when the temperature reduction function is released, the controller 170 may reset the cumulative current X to zero upon receiving the command for setting the temperature reduction function, without calculating the cumulative current X.

At time t1, the controller 170 may receive the command for setting the temperature reduction function, and the current limit value Y may be the normal limit value Y1. The current limit value Y for the first time t1 to t2 may be the normal limit value Y1 of 14.

At time t2, the controller 170 may obtain the difference d of 5 obtained by subtracting the reference value of 9 from the present current of 14 and calculate the cumulative current X of 5 that is the sum of the immediately previous cumulative current X−1 of 0 and the difference d of 5. Since the cumulative current X of 5 at time t2 is less than 20 that is the decrease condition value X1, the current limit value Y for the second time t2 to t3 may be the normal limit value Y1 of 14.

At time t3, the controller 170 may obtain the difference d of 5 obtained by subtracting the reference value of 9 from the present current of 14 and calculate the cumulative current X of 10 that is the sum of the immediately previous cumulative current X−1 of 5 and the difference d of 5. Since the cumulative current X of 10 at time t3 is less than 20 that is the decrease condition value X1, the current limit value Y for the third time t3 to t4 may be the normal limit value Y1 of 14.

At time t4, the controller 170 may obtain the difference d of 5 obtained by subtracting the reference value of 9 from the present current of 14 and calculate the cumulative current X of 15 that is the sum of the immediately previous cumulative current X−1 of 10 and the difference d of 5. Since the cumulative current X of 15 at time t4 is less than 20 that is the decrease condition value X1, the current limit value Y for the $4^{th}$ time t4 to t5 may be the normal limit value Y1 of 14.

At time t5, the controller 170 may obtain the difference d of 5 obtained by subtracting the reference value of 9 from the present current of 14 and calculate the cumulative current X of 20 that is the sum of the immediately previous cumulative current X−1 of 15 and the difference d of 5. Since the cumulative current X of 20 at time t5 is greater than 20 that is the decrease condition value X1, the controller 170 may reduce the current limit value Y from 14, which is the normal limit value Y1, to 10, which is the luminance limit value Y2, at time t5. For example, the controller 170 may gradually decrease the current limit value Y for the $5^{th}$ time t5 to t6.

At time t6, the controller 170 may obtain the difference d of 1 obtained by subtracting the reference value of 9 from the present current of 10 and calculate the cumulative current X of 21 that is the sum of the immediately previous cumulative current X−1 of 20 and the difference d of 1. At time t6 when the current limit value Y is set to the luminance limit value Y2, since the cumulative current X of 21 is greater than 10, which is the increase condition value X2, the current limit value Y may be the luminance limit value Y2 of 10 for the $6^{th}$ time t6 to t7. On the other hand, since the cumulative current X of 21 is less than 25 which is the maximum value Max X, the controller 170 may maintain the cumulative current X of 21.

Figure 12:
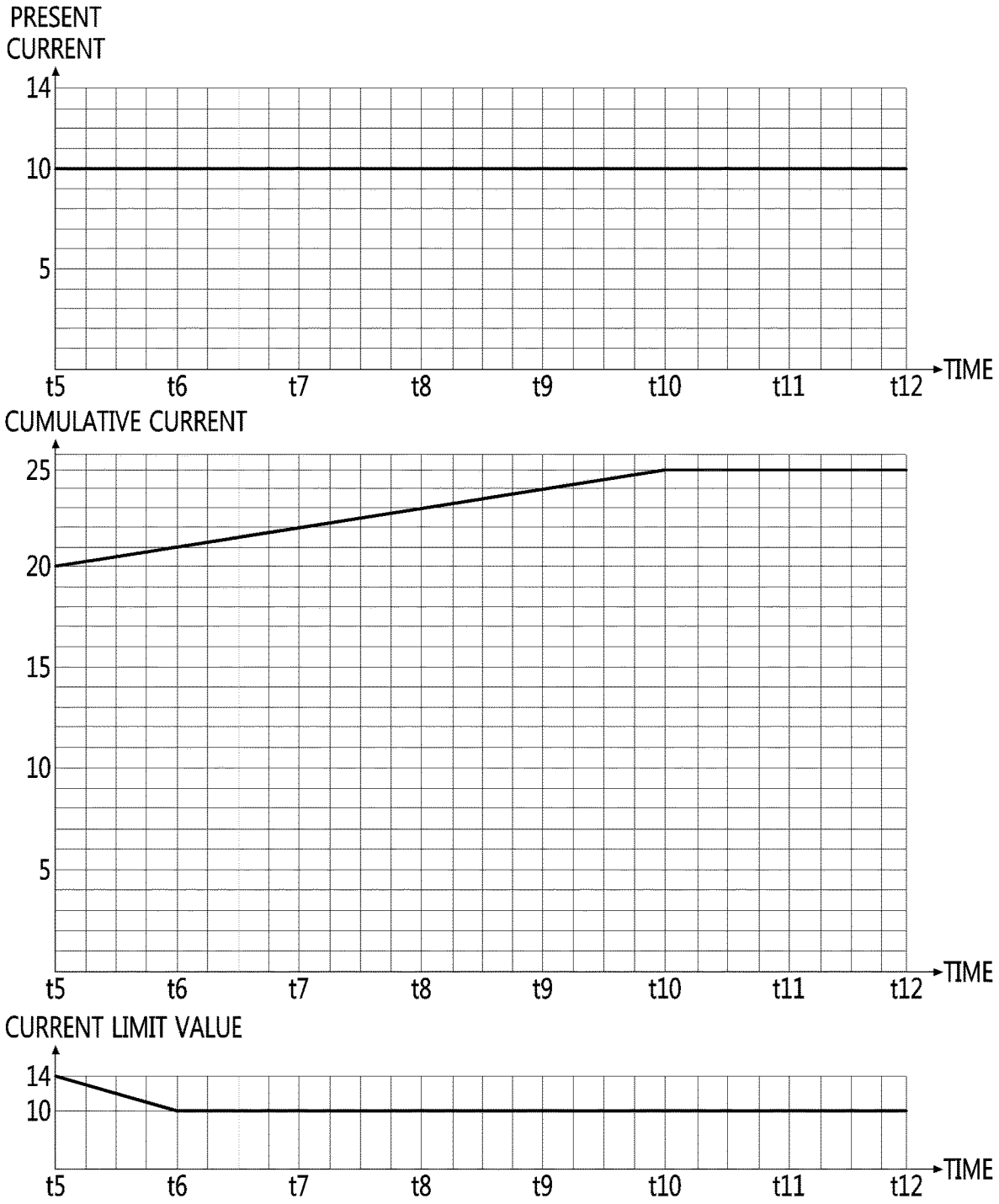

Referring to FIG. 12, at time t7, the controller 170 may obtain the difference d of 1 obtained by subtracting the reference value of 9 from the present current of 10 and calculate the cumulative current X of 22 that is the sum of the immediately previous cumulative current X−1 of 21 and the difference d of 1. Since the cumulative current X of 22 at time t7 is greater than 10 that is the increase condition value X2, the current limit value Y for the $7^{th}$ time t7 to t8 may be the luminance limit value Y2 of 10. On the other hand, since the cumulative current X of 22 is less than 25 that is the maximum value Max X, the controller 170 may maintain the cumulative current X of 21.

At time t8, the controller 170 may obtain the difference d of 1 obtained by subtracting the reference value of 9 from the present current of 10 and calculate the cumulative current X of 23 that is the sum of the immediately previous cumulative current X−1 of 22 and the difference d of 1. Since the cumulative current X of 23 at time t8 is greater than 10 that is the increase condition value X2, the current limit value Y for the $8^{th}$ time t8 to t9 may be the luminance limit value Y2 of 10. On the other hand, since the cumulative current X of 23 is less than 25 that is the maximum value Max X, the controller 170 may maintain the cumulative current X of 21.

At time t9, the controller 170 may obtain the difference d of 1 obtained by subtracting the reference value of 9 from the present current of 10 and calculate the cumulative current X of 24 that is the sum of the immediately previous cumulative current X−1 of 23 and the difference d of 1. Since the cumulative current X of 24 at time t9 is greater than 10 that is the increase condition value X2, the current limit value Y for the $9^{th}$ time t9 to t10 may be the luminance limit value Y2 of 10. On the other hand, since the cumulative current X of 24 is less than 25 that is the maximum value Max X, the controller 170 may maintain the cumulative current X of 21.

At time t10, the controller 170 may obtain the difference d of 1 obtained by subtracting the reference value of 9 from the present current of 10 and calculate the cumulative current X of 25 that is the sum of the immediately previous cumulative current X−1 of 24 and the difference d of 1. Since the cumulative current X of 25 at time t10 is greater than 10 that is the increase condition value X2, the current limit value Y for the $10^{th}$ time t10 to t11 may be the luminance limit value Y2 of 10. On the other hand, since the cumulative current X of 25 is equal to 25 that is the maximum value Max X, the controller 170 may correct the cumulative current X to 25.

At time t11, the controller 170 may obtain the difference d of 1 obtained by subtracting the reference value of 9 from the present current of 10 and calculate the cumulative current X of 26 that is the sum of the immediately previous cumulative current X−1 of 25 and the difference d of 1. Since the cumulative current X of 26 at time t11 is less than 10 that is the increase condition value X2, the current limit value Y for the $11^{th}$ time t11 to t12 may be the luminance limit value Y2 of 10. On the other hand, since the cumulative current X of 26 is less than 25 that is the maximum value Max X, the controller 170 may correct the cumulative current X to the maximum value Max X of 25.

At time t12, the controller 170 may obtain the difference d of 1 obtained by subtracting the reference value of 9 from the present current of 10 and calculate the cumulative current X of 26 that is the sum of the corrected immediately previous cumulative current X−1 of 25 and the difference d of 1. Since the cumulative current X of 26 at time t12 is less than 10 that is the increase condition value X2, the current limit value Y for the $12^{th}$ time t12 to t13 may be the luminance limit value Y2 of 10. On the other hand, since the cumulative current X of 26 is less than 25 that is the maximum value Max X, the controller 170 may correct the cumulative current X to the maximum value Max X of 25.

Figure 13:
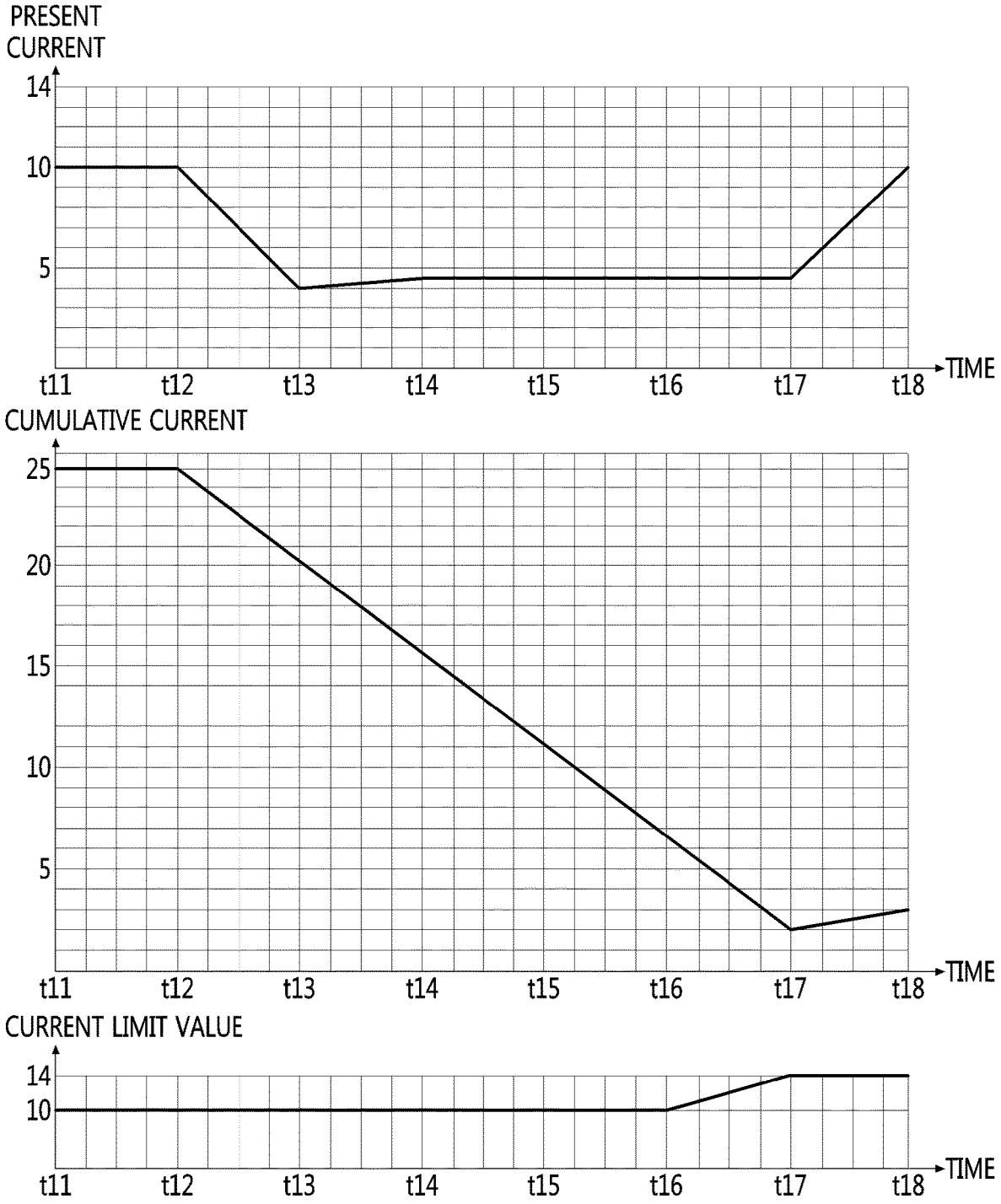

Referring to FIG. 13, at time t13, the controller 170 may obtain the difference d of −5 obtained by subtracting the reference value of 9 from the present current of 4 and calculate the cumulative current X of 20 that is the sum of the corrected immediately previous cumulative current X−1 of 25 and the difference d of −5. Since the cumulative current X of 20 at time t13 is greater than 10 that is the increase condition value X2, the current limit value Y for the $13^{th}$ time t3 to t14 may be the luminance limit value Y2 of 10. On the other hand, since the cumulative current X of 20 is less than 25 that is the maximum value Max X, the controller 170 may maintain the cumulative current X of 20.

At time t14, the controller 170 may obtain the difference d of −4.5 obtained by subtracting the reference value of 9 from the present current of 4.5 and calculate the cumulative current X of 15.5 that is the sum of the immediately previous cumulative current X−1 of 20 and the difference d of −4.5. Since the cumulative current X of 15.5 at time t14 is greater than 10 that is the increase condition value X2, the current limit value Y for the $14^{th}$ time t14 to t15 may be the luminance limit value Y2 of 10. On the other hand, since the cumulative current X of 15.5 is less than 25 that is the maximum value Max X, the controller 170 may maintain the cumulative current X of 15.5.

At time t15, the controller 170 may obtain the difference d of −4.5 obtained by subtracting the reference value of 9 from the present current of 4.5 and calculate the cumulative current X of 11 that is the sum of the immediately previous cumulative current X−1 of 15.5 and the difference d of −4.5. Since the cumulative current X of 11 at time t15 is less than 10 that is the increase condition value X2, the current limit value Y for the $15^{th}$ time t15 to t16 may be the luminance limit value Y2 of 10. On the other hand, since the cumulative current X of 11 is less than 25 that is the maximum value Max X, the controller 170 may maintain the cumulative current X of 11.

At time t16, the controller 170 may obtain the difference d of −4.5 obtained by subtracting the reference value of 9 from the present current of 4.5 and calculate the cumulative current X of 6.5 that is the sum of the immediately previous cumulative current X−1 of 11 and the difference d of −4.5. Since the cumulative current X of 6.5 at time t16 is less than 10 that is the increase condition value X2, the controller 170 may increase the current limit value Y from 10, which is the luminance limit value Y2, to 14, which is the normal limit value Y1, at time t16. For example, the controller 170 may gradually increase the current limit value Y for the $16^{th}$ time t16 to t17.

At time t17, the controller 170 may obtain the difference d of −4.5 obtained by subtracting the reference value of 9 from the present current of 4.5 and calculate the cumulative current X of 2 that is the sum of the immediately previous cumulative current X−1 of 6.5 and the difference d of −4.5. Since the cumulative current X of 2 at time t17 is less than 20 that is the decrease condition value X1, the current limit value Y for the $17^{th}$ time t17 to t18 may be the normal limit value Y1 of 14. On the other hand, since the cumulative current X of 2 is greater than 1 that is the minimum value Min X, the controller 170 may maintain the cumulative current X of 2.

Figure 14:
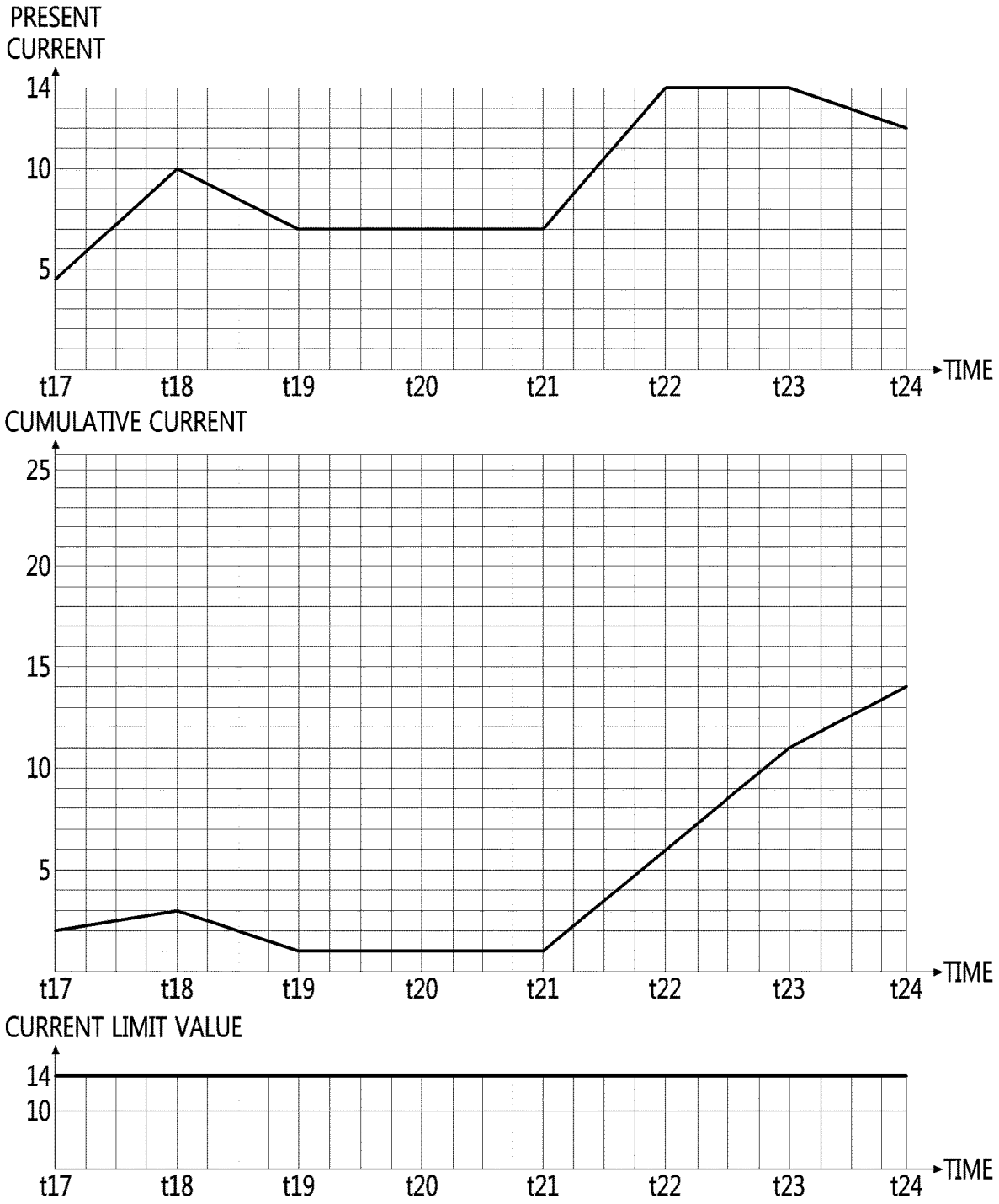

Referring to FIG. 14, at time t18, the controller 170 may obtain the difference d of 1 obtained by subtracting the reference value of 9 from the present current of 10 and calculate the cumulative current X of 3 that is the sum of the immediately previous cumulative current X−1 of 2 and the difference d of 1. Since the cumulative current X of 3 at time t18 is less than 20 that is the decrease condition value X1, the current limit value Y for the $18^{th}$ time t18 to t19 may be the normal limit value Y1 of 14. On the other hand, since the cumulative current X of 3 is greater than 1 that is the minimum value Min X, the controller 170 may maintain the cumulative current X of 3.

At time t19, the controller 170 may obtain the difference d of −2 obtained by subtracting the reference value of 9 from the present current of 7 and calculate the cumulative current X of 1 that is the sum of the immediately previous cumulative current X−1 of 3 and the difference d of 1. Since the cumulative current X of 1 at time t19 is less than 20 that is the decrease condition value X1, the current limit value Y for the $19^{th}$ time t19 to t20 may be the normal limit value Y1 of 14. On the other hand, since the cumulative current X of 1 is greater than 1 that is the minimum value Min X, the controller 170 may maintain the cumulative current X of 1.

At time t20, the controller 170 may obtain the difference d of −2 obtained by subtracting the reference value of 9 from the present current of 7 and calculate the cumulative current X of −1 that is the sum of the immediately previous cumulative current X−1 of 1 and the difference d of −2. Since the cumulative current X of −1 at time t20 is less than 20 that is the decrease condition value X1, the current limit value Y for the $20^{th}$ time period t20 to t21 may be the normal limit value Y1 of 14. On the other hand, since the cumulative current X of −1 is greater than 1 that is the minimum value Min X, the controller 170 may correct the cumulative current X from −1 to 1.

At time t21, the controller 170 may obtain the difference d of −2 obtained by subtracting the reference value of 9 from the present current of 7 and calculate the cumulative current X of −1 that is the sum of the corrected cumulative current X−1 of 1 and the difference d of −2. Since the cumulative current X of −1 at time t21 is less than 20 that is the decrease condition value X1, the current limit value Y for the $21^{st}$ time t21 to t22 may be the normal limit value Y1 of 14. On the other hand, since the cumulative current X of −1 is greater than 1 that is the minimum value Min X, the controller 170 may correct the cumulative current X from −1 to 1.

At time t22, the controller 170 may obtain the difference d of 5 obtained by subtracting the reference value of 9 from the present current of 14 and calculate the cumulative current X of 6 that is the sum of the corrected cumulative current X6 of 1 and the difference d of 5. Since the cumulative current X of 6 at time t22 is less than 20 that is the decrease condition value X1, the current limit value Y for the $22^{nd}$ time t22 to t23 may be the normal limit value Y1 of 14. On the other hand, since the cumulative current X of 6 is greater than 1 that is the minimum value Min X, the controller 170 may maintain the cumulative current X of 6.

At time t23, the controller 170 may obtain the difference d of 5 obtained by subtracting the reference value of 9 from the present current of 14 and calculate the cumulative current X of 17 that is the sum of the immediately previous cumulative current X−1 of 6 and the difference d of 11. Since the cumulative current X of 17 at time t23 is less than 20 that is the decrease condition value X1, the current limit value Y for the $23^{rd}$ time t23 to t24 may be the normal limit value Y1 of 14.

At time t24, the controller 170 may obtain the difference d of 3 obtained by subtracting the reference value of 9 from the present current of 12 and calculate the cumulative current X of 20 that is the sum of the immediately previous cumulative current X−1 of 17 and the difference d of 3.

Since the cumulative current X of 20 at time t24 is equal to 20 that is the decrease condition value X1, the controller 170 may reduce the current limit value Y from 14, which is the normal limit value Y1, to 10, which is the luminance limit value Y2, at time t25.

According to the second embodiment of the present invention, since the current limit value Y is changed based on the cumulative current X rather than the current supplied to the OLED panel 210, it is possible to minimize the case where the luminance of the video suddenly changes even if the R, G, and B data of the output image suddenly change. For example, when the output video is changed from a video with mostly white areas to a video with mostly black areas or changed vice versa, the difference of the present current supplied to the OLED panel 210 may be greater than the difference of the cumulative current when the output video is changed from a video with mostly white areas to a video with mostly black areas, or vice versa. In particular, if the current limit value Y is decreased when the current limit value Y is higher for a predetermined time as in t1 to t5 of FIG. 11 and the present current is suddenly increased as in t21 to t23 of FIG. 14, the case where the current limit value Y is not changed and the luminance of the video suddenly changes can be minimized.

According to the embodiment of the present invention, there is an advantage that the temperature of the panel can be reduced by adjusting the current limit value based on the information about the current supplied to the panel, thereby minimizing the problem of overheating the panel.

Further, there is an advantage that the user inconvenience due to sudden change in the video luminance can be minimized by adjusting the current limit value based on the cumulative current calculated according to the present current supplied to the panel.

In addition, when the current limit value is lowered based on the cumulative current, the current limit value is not immediately increased even though the supply current to the panel is temporarily reduced, and the time for the panel temperature to be lowered is secured, thereby minimizing the overheating of the panel.

In addition, if the cumulative current is lowered to an infinite degree, even when the supply current to the panel is increased, the time required until the current limit value is lowered again is prolonged, thereby minimizing the overheating of the panel.

In addition, if the cumulative current is increased to an infinite degree, even when the supply current to the panel is decreased, the time required until the current limit value is increased again is prolonged, thereby minimizing the problem of delaying the recovery of the video luminance.

In addition, there is an advantage that the user can select the priority among the solving of the panel overheating problem and the securing of the video luminance through the setting/release of the temperature reduction function.

In addition, when the temperature reduction function is changed from the released state to the set state, the cumulative current is reset to zero, thereby minimizing the problem of changing the performance whenever the temperature reduction function is set, thereby improving the reliability.

In addition, it is possible to minimize the sudden change in luminance by rapidly increasing or decreasing the current limit value by the set ratio at the time of adjustment.

According to another embodiment of the present invention, a simple algorithm for adjusting the current limit value according to the current supplied to the panel reduces the temperature of the panel and minimizes the occurrence of errors.

The above description is merely illustrative of the technical idea of the present invention, and various modifications and changes may be made thereto by those skilled in the art without departing from the essential characteristics of the present invention.

Therefore, the embodiments of the present invention are not intended to limit the technical spirit of the present invention but to illustrate the technical idea of the present invention, and the technical spirit of the present invention is not limited by these embodiments.

The scope of protection of the present invention should be interpreted by the appending claims, and all technical ideas within the scope of equivalents should be construed as falling within the scope of the present invention.

What is claimed is:

1. A display device comprising:

a panel in which a plurality of pixels are disposed;

a power supplier configured to supply a current to the panel; and a controller configured to:

receive information on the supplied current;

determine a cumulative current based on the received information;

set a current limit value such that the supplied current is equal to or less than the set current limit value; and adjust the set current limit value to a first limit value or a second limit value based on the determined cumulative current, wherein the second limit value is less than the first limit value.

2. The display device according to claim 1, wherein the controller is further configured to determine the cumulative current by summing respective differences between a present current supplied to the panel and a reference value for each set period of time.

3. The display device according to claim 2, wherein the controller is further configured to determine the cumulative current at a certain instance of time T by summing the difference between a present current supplied to the panel and a reference value at the certain time T and the cumulative current at an immediately previous instance of time T−1.

4. The display device according to claim 2, wherein the reference value is less than the second limit value.

5. The display device according to claim 1, wherein the controller is further configured to:

set the current limit value to the second limit value when the cumulative current is equal to or greater than a decrease condition value, wherein the decrease condition value serves as a reference value for decreasing the current limit value; and set the current limit value to the first limit value when the cumulative value is less than an increase condition value, wherein the increase condition value serves as a reference for increasing the current limit value.

6. The display device according to claim 5, wherein the controller is configured to:

maintain the current limit value at the first limit value when the current limit value is set to the first limit value and the cumulative current is less than the decrease condition value; and maintain the current limit value at the second limit value when the current limit value is set to the second limit value and the cumulative current is at the increase condition value or more.

7. The display device according to claim 1, wherein the controller is configured to correct the cumulative current to a preset minimum value when the cumulative current is less than the preset minimum value.

8. The display device according to claim 1, wherein the controller is configured to correct the cumulative current to a preset maximum value when the cumulative current is at the preset maximum value or more.

9. The display device according to claim 1, wherein the controller is configured to:

adjust the current limit value when a temperature reduction function is set; and fix the current limit value when the temperature reduction function is released.

10. The display device according to claim 9, wherein the controller is configured to:

set the current limit value to the first limit value or the second limit value less than the first limit value when the temperature reduction function is set; and fix the current limit value to one of the first limit value and the second limit value when the temperature reduction function is released.

11. The display device according to claim 9, wherein the controller is configured to:

reset the cumulative current to zero and calculate the cumulative current when a setting command of the temperature reduction function is received in a state in which the temperature reduction function is released; and set the current limit value to the first limit value or the second limit value based on the cumulative current.

12. The display device according to claim 1, wherein the controller is further configured to gradually increase the current limit value according to a setting ratio or gradually decrease the current limit value according to the setting ratio when the current limit value is adjusted.

13. The display device according to claim 1, wherein the controller is further configured to compare a present current supplied to the panel with a third limit value and set the current limit value to a first limit value or a second limit value less than a normal limit value, wherein the controller is preferably configured to set the current limit value to the first limit value when the present current is less than the third limit value, and set the current limit value to the second limit value when the present current is the third limit value or more.

14. An operating method of a display device comprising a panel in which a plurality of pixels are disposed, the operating method comprising:

supplying a current to the panel;

receiving information on the supplied current;

determining a cumulative current based on the received information;

setting a current limit value such that the supplied current is equal to or less than the set current limit value; and adjusting the set current limit value to a first limit value or a second limit value based on the determined cumulative current, wherein the second limit value is less than the first limit value.

15. The operating method of the display device according to claim 14, wherein the determining the cumulative current comprises determining the cumulative current by summing respective differences between a present current supplied to the panel and a reference value for each set period of time.

16. The operating method of the display device according to claim 14, wherein the adjusting the set current limit value further comprises:

setting the current limit value to the second limit value when the cumulative current is at or above a decrease condition value, wherein the decrease condition value serves as a reference value for decreasing the current limit value; and setting the current limit value to the first limit value when the cumulative value is less than an increase condition value, wherein the increase condition value serves as a reference for increasing the current limit value.

17. The operating method of the display device according to claim 16, further comprising:

maintaining the current limit value at the first limit value when the current limit value is set to the first limit value and the cumulative current is less than the decrease condition value; and maintaining the current limit value at the second limit value when the current limit value is set to the second limit value and the cumulative current is at the increase condition value or more.

18. The operating method of the display device according to claim 14, further comprising:

correcting the cumulative current to a preset minimum value when the cumulative current is less than the preset minimum value.

* * * * *